US006612020B2

(12) United States Patent
Sanders

(10) Patent No.: US 6,612,020 B2
(45) Date of Patent: Sep. 2, 2003

(54) APPARATUS FOR SUPERPLASTIC FORMING OF TUBING

(75) Inventor: Daniel G. Sanders, Sumner, WA (US)

(73) Assignee: The Boeing Company, Seattle, MA (US)

( * ) Notice: Subject to any disclaimer, the term of this patent is extended or adjusted under 35 U.S.C. 154(b) by 0 days.

(21) Appl. No.: 10/158,022

(22) Filed: May 29, 2002

(65) Prior Publication Data

US 2002/0194891 A1 Dec. 26, 2002

Related U.S. Application Data

(62) Division of application No. 09/141,499, filed on Aug. 28, 1998, now Pat. No. 6,430,812.
(60) Provisional application No. 60/057,153, filed on Aug. 28, 1997.

(51) Int. Cl.[7] ..... B23P 21/00; B21K 1/16
(52) U.S. Cl. ..... 29/715; 29/714; 29/507; 29/890.148
(58) Field of Search ..... 29/890.148, 464, 29/507, 709, 715, 714, 717; 72/370.27, 370.04, 370.01, 342.6

(56) References Cited

U.S. PATENT DOCUMENTS

| | | | | | |
|---|---|---|---|---|---|
| 2,238,037 | A | * | 4/1941 | Cornell | 29/890.148 |
| 2,507,859 | A | * | 5/1950 | Keller | 29/890.15 |
| 3,927,817 | A | | 12/1975 | Hamilton et al. | |
| 4,361,262 | A | | 11/1982 | Israeli | |
| 4,384,840 | A | | 5/1983 | Desplanches et al. | |
| 4,449,281 | A | | 5/1984 | Yoshida et al. | |
| 4,590,655 | A | | 5/1986 | Javorik | |
| 4,676,088 | A | * | 6/1987 | Okada et al. | 29/890.148 |
| 4,840,053 | A | | 6/1989 | Nakamura | |
| 4,875,270 | A | | 10/1989 | Krips et al. | |
| 5,214,948 | A | | 6/1993 | Sanders et al. | |
| 5,419,171 | A | | 5/1995 | Bumgarner | |
| 5,435,163 | A | | 7/1995 | Schäfer | |
| 5,467,626 | A | | 11/1995 | Sanders | |
| 5,485,737 | A | | 1/1996 | Dickerson | |
| 5,649,439 | A | * | 7/1997 | Schulz | 72/62 |
| 5,988,225 | A | * | 11/1999 | Schulz | 29/447 |
| 6,081,982 | A | * | 7/2000 | Schulz | 29/447 |

FOREIGN PATENT DOCUMENTS

| | | | | |
|---|---|---|---|---|
| EP | 322722 A2 | * | 7/1989 | 29/890.148 |
| JP | 355122627 A | * | 9/1980 | 29/890.148 |

* cited by examiner

*Primary Examiner*—Gregory Vidovich
*Assistant Examiner*—Marc Jimenez
(74) *Attorney, Agent, or Firm*—John C. Hammar

(57) ABSTRACT

A tubular part having a tubular main body and an integral tubular pullout projecting laterally from the side of the main body and in fluid-tight communication therewith is superplastically formed by inserting the tube in a cavity of a die base and heating the die to a temperature at which the material of which the tube is made exhibits superplastic properties. The distal end of a pull-rod is extended through an opening in the die base and through a hole in the side wall aligned with the opening. A pull-die is selected having a cross section larger than the hole and about equal to the desired internal cross section of the tubular protrusion. The pull die is attached to the distal end of the rod and (before or after attachment) is heated to about the superplastic temperature of the tubing material. Linear actuators are operated to pull the rod and attached pull die through the hole at a predetermined rate which produces about an optimal superplastic strain rate for the material, thereby superplastically stretching marginal portions of the tubular body around the hole and forming the tubing material in marginal regions around the hole against surfaces defining the opening in the die base into the tubular pullout integrally joined to the tube around an integral junction region.

5 Claims, 21 Drawing Sheets disp. scale factor = .100E+01 (default)

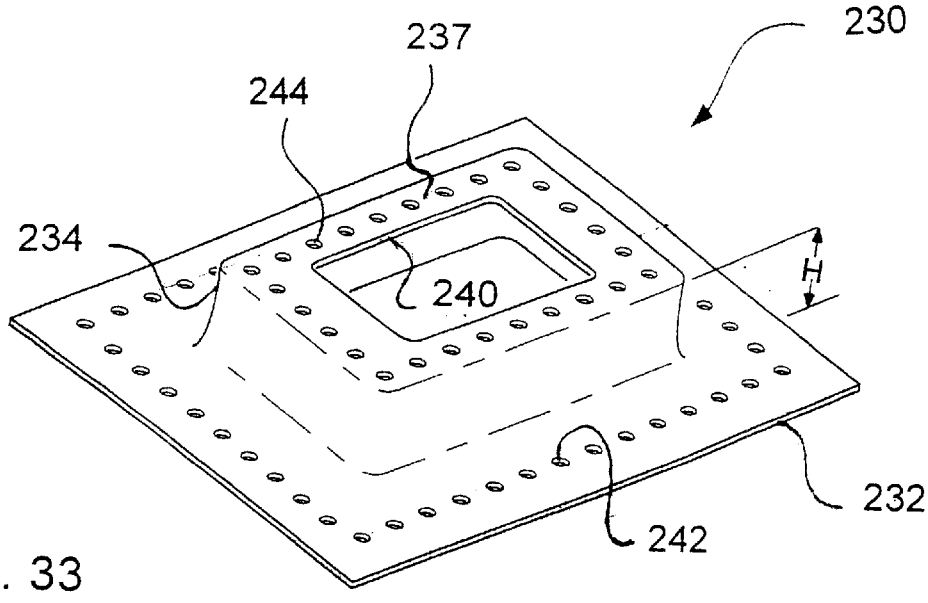
Fig. 33
Fig. 34
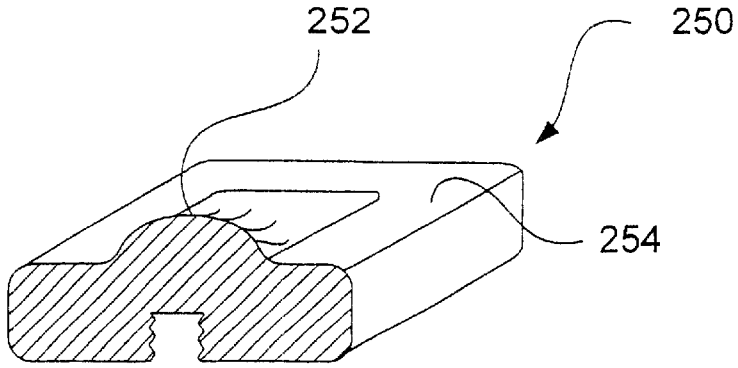

APPARATUS FOR SUPERPLASTIC FORMING OF TUBING

REFERENCE TO RELATED APPLICATION

The present application is a divisional application based upon U.S. patent application Ser. No. 09/141,499, filed Aug. 28, 1998 now U.S. Pat. No. 6,430,812, which claimed the benefit of U.S. Provisional Patent Application No. 60/057,153, filed Aug. 28, 1997.

FIELD OF THE INVENTION

This invention relates to pullouts in tubing and ducts for conveying fluids, and more particularly, to tubing or ducts made of materials exhibiting superplastic properties and having integral protrusion formations, (i.e., "a pullout") formed by superplastic forming, by which other matching parts can be attached to produce a fluid-tight system.

BACKGROUND OF THE INVENTION

Tubing and duct systems for conveying fluids are in widespread use in many industries. In the aerospace industry, welded ducts are used in the environmental control system and in the wing de-icing system for conveying heated air from the engine to the leading edges and nacelle inlet nose to prevent ice from forming on those critical surfaces in icing conditions in flight. These and other duct systems have elbows, "T" ducts, flanges and other components used to assemble the complete system. A "T-duct" is a short length of tubing having an integral tubular protrusion from the duct side wall by which a side duct can be attached, as by welding or coupling hardware, into a duct line. This protrusion is commonly known as a "pullout."

Two methods for making a tubular part, such as a "T" duct, with an integral pullout are taught in U.S. Pat. No. 5,649,439 issued on Jul. 22, 1997, to David W. Schulz, entitled "Tool for Sealing Superplastic Tube". Both methods use gas pressure to superplastically form a portion of a side wall of an end-sealed tube, heated to superplastic temperature in a die, into a side pocket of the die to form the pullout. The formed tube is cooled and removed from the die, and the end of the pullout is trimmed off to remove the cap and to give the pullout a planar lip.

These methods reliably and repeatably produce parts as designed, but have one shortcoming that, in aerospace applications in particular, has significant economic consequences. Since the end cap of the pullout bulge must remain intact to contain the pressurized forming gas, the material in the cap is not available for use in the pullout side wall. Accordingly, to prevent excessive thinning of the pullout, a thicker tube than is required by the engineering specifications for that duct system must be used. That thicker tube, carried just to avoid the excessive thinout of the pullout lip, can add several pounds to an airplane de-icing duct system, for example. In the aerospace industry, in particular, wherein weight is an important factor in the design of any system, even a few pounds of weight in excess of that required by the engineering specifications is looked upon with disfavor.

Another problem with excessive thinning of the pullout on a tubular part occurs when the mating duct is welded to the pullout. Welding of thin-wall ducts and tubing requires careful control of the welding power and speed to obtain a weld bead with the desired penetration and mass, and to avoid burn-through or other over heating problems. Welding a pullout joint that has been thinned, to a fresh section of straight tubing with a thicker wall, presents a difficult challenge that requires the skills of a master welder. Oftentimes even the best welders are unable to manage keeping an even weld bead or avoid blow-through holes because of the difference in the amount of parent material being melted around the pullout. Many parts are scrapped because of non-conforming weld bead width, insufficient weld penetration, blow holes, weld-line porosity, inclusions and other defects that can be attributed to the variation of thickness surrounding the pullout.

The radius area where the pullout joins the tube is a high stress area on an airplane de-icing duct system due to bending stresses caused by movement of the wings in flight, thermal stresses and sonic fatigue. All of these factors generate stresses that are transmitted along the spurs of the duct to the joint at the formed pullout radius where the pullout meets the mainline section of the straight tube. For this reason, there is a structural benefit in locating the weld bead of the tube welded to the pullout as far as possible from the pullout radius, so the stresses that are concentrated at the pullout radius are not concentrated at the weld bead, since the welding process introduces defects such as porosity in the weld and decreases the structural load capacity of the duct around the weld.

Another existing tube pullout production technique is a ball pulling process that is used to produce the same type of aerospace ducting tee's and joints. A round hole is cut in the sidewall of a tube in a position where the pullout is to be formed. A ball that is slightly larger in diameter than the hole is pulled through the hole to form a pullout with the same inside diameter as the outside diameter of the ball. The process is designed in such a way that the ram of a hydraulic actuator can be run up inside the tube through the hole, a ball screwed onto the threaded end of the ram, and the ball pulled through the hole using the hydraulic action of the actuator. The pullout shape is controlled by a die which has a machine cut draw radius around which the pullout forms as the ball stretches the material outward.

An enhanced ball pulling process heats the ball to a temperature of about 1000° F. During pulling, heat from the hot ball is conducted to the tubing material in the region that will be stretched into the pullout, heating it to an elevated temperature, near the temperature of the ball. A slight increase in ductility is realized by heating the ducting material. For example, the possible elongation of commercially pure titanium made in accordance with Mil Standard Mil-T-9046J, CP-1 at room temperature is about 25%; at 1000° F. its possible elongation is about 28%.

The problem with the conventional or heated ball pullout process is cracking and excessive thinout around the lip of the pullout. The forming stresses and elongations that result during forming often surpass the formability limits of the material. The strain needed to form the pullout causes a high scrap rate due to cracking. Aerospace ducting systems are usually designed to approach the minimum thickness to save weight, hence thinout at the lip of the pullout can reduce the lip thickness below the acceptable minimum. Many parts are scrapped because the pullout lip is thinner than this engineering designed minimum thickness.

The conventional pullout forming process has many variables that contribute to the high scrap rate. The ductility of alloys used in ducting systems can vary from lot to lot. Elongation differences of only 1 or 2% in the raw material properties can have a significant impact on cracking and thinout.

In addition to variations in the material, it is difficult to precisely locate the hole cut in the tube relative to the position and linear path that the ball travels when the pullout is made. A misalignment of even 0.005" can have a significant effect on the elongation of the pullout sidewalls. Many process failures occur in which the pullout depth is slightly short on one side and is longer and cracked on the opposite side, resulting from slight misalignment of the hole with the ball travel path.

Because the conventional pullout forming process causes thinout in the same location that is the most highly stressed, welded duct systems in airplanes have always been designed with thicker tube walls than would otherwise be necessary, thereby increasing the weight of the airplane duct system. The weight is especially undesirable in wing de-icing systems because there is a multiplier effect for the impact of weight for weight added to the wings.

Thus, there has long been an unsatisfied need in the industry for a process for making pullouts that does not suffer from excessive thinning of the rim of the pullout and which avoids cracking or bursting in the highly strained regions around the rim on the pullout. The benefits of producing a flange, pullout, or T-duct with reduced thickness variation would extend to both aerospace manufacturing and design capabilities, and also to commercial and industrial applications.

SUMMARY OF THE INVENTION

Accordingly, the present invention provides an improved method of making a tubular part having a tubular body and a superplastically formed tubular protrusion extending at an obtuse angle from the tubular body and in fluid tight communication therewith. Another feature of this invention provides an improved reliable method with a low scrap rate of making a tubular pullout on a duct or other tubular body of superplastic material by which the duct can be connected to adjacent ducts or other tubular members in a fluid conduction system. The invention, accordingly, provides an improved tubular part having an integral pullout formed by superplastic forming and having an acceptable degree of thin-out within the engineering design at the rim of the pullout to facilitate connection of ducts or other tubular members to the tubular in an assembly. A still further feature of this invention is the apparatus for superplastic forming of tubular pullouts on a tubular part.

These and other features of the invention are attained in a method of making a superplastically formed integral tubular pullout in a side wall of a tube for making parts such as tubular elbows and tees. The preferred method includes the steps of inserting the tube in a cavity of a die base and heating the die to a temperature at which the material of which the tube is made exhibits superplastic properties. A distal end of a rod is extended through an opening in the die base and through a hole in the side wall of the tube aligned with the opening in the die. A pull die, having a cross section larger than the hole and about equal to the desired internal cross section of the tubular protrusion, is attached to the distal end of the rod, the pull die is heated to about the superplastic temperature and is pulled through the hole, superplastically forming the tubing material in marginal regions around the hole against surfaces defining the opening in the die base into the tubular protrusion integrally joined to the tube with an integral junction region. Optimal elongations are achieved using optimal strain rates that minimize grain growth and achieve economical production rates. Material thinout around the rim of the pullout is significantly reduced, and the process enables the use of more extreme pullout designs. Variations of the process include formed pullouts on flat or contoured flanges for joining ducting components that are non-circular in cross-section.

DESCRIPTION OF THE DRAWINGS

The invention and its many attendant features and advantages will become better understood on reading the following description of the preferred embodiments in conjunction with the following drawings.

FIG. 33 is a perspective view of a reducing flange formed in accordance with this invention.

FIG. 34 is a sectional perspective view of a die used to make the part shown in FIG. 33.

DESCRIPTION OF THE PREFERRED EMBODIMENTS

Figure 1:
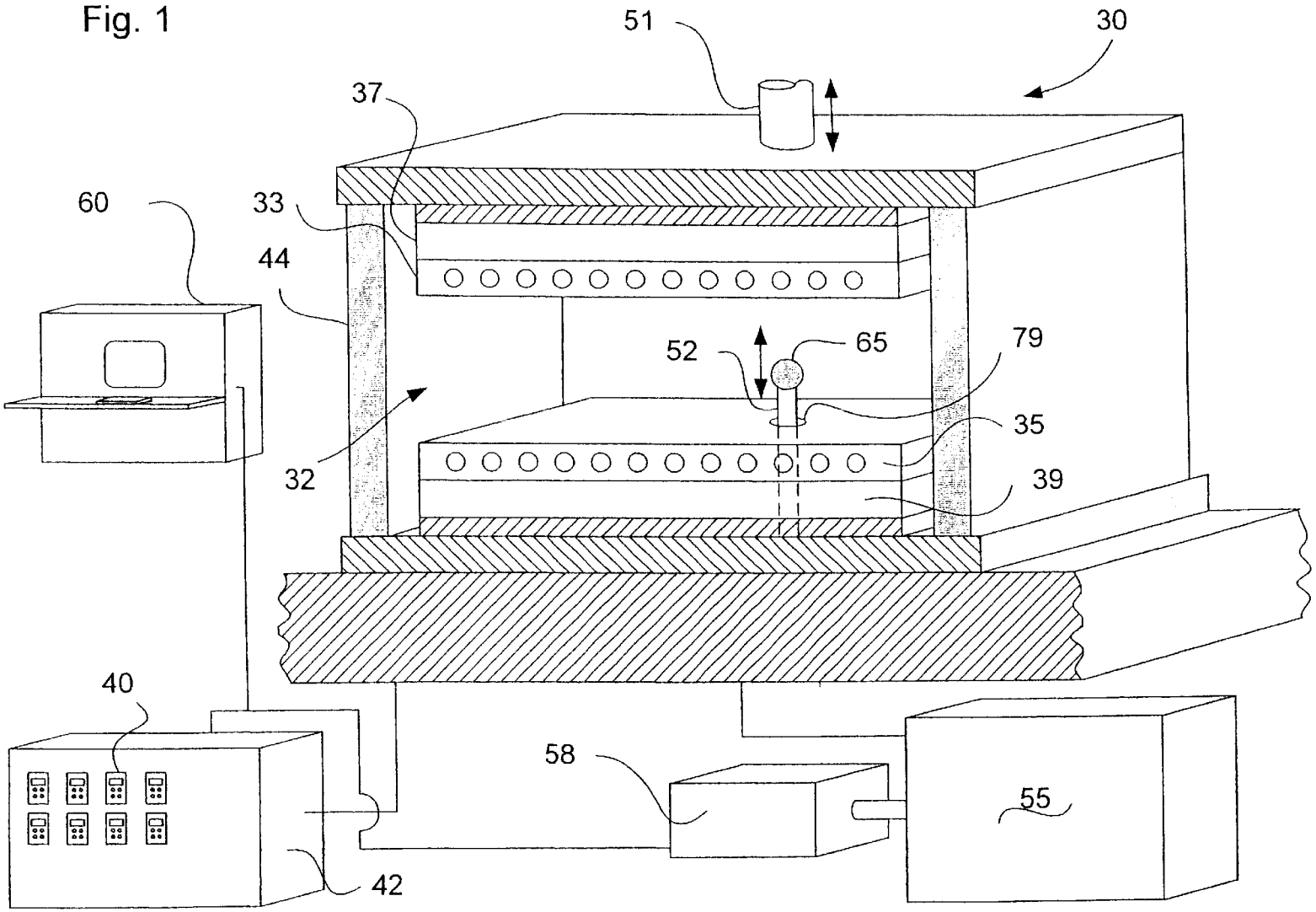
FIG. 1 is a perspective schematic view of a system, including associated controls and actuators, for supporting a tube while heating it to superplastic temperature, and for pulling a pull die through a hole in the tube to form a pullout in accordance with this invention.
Figure 2:
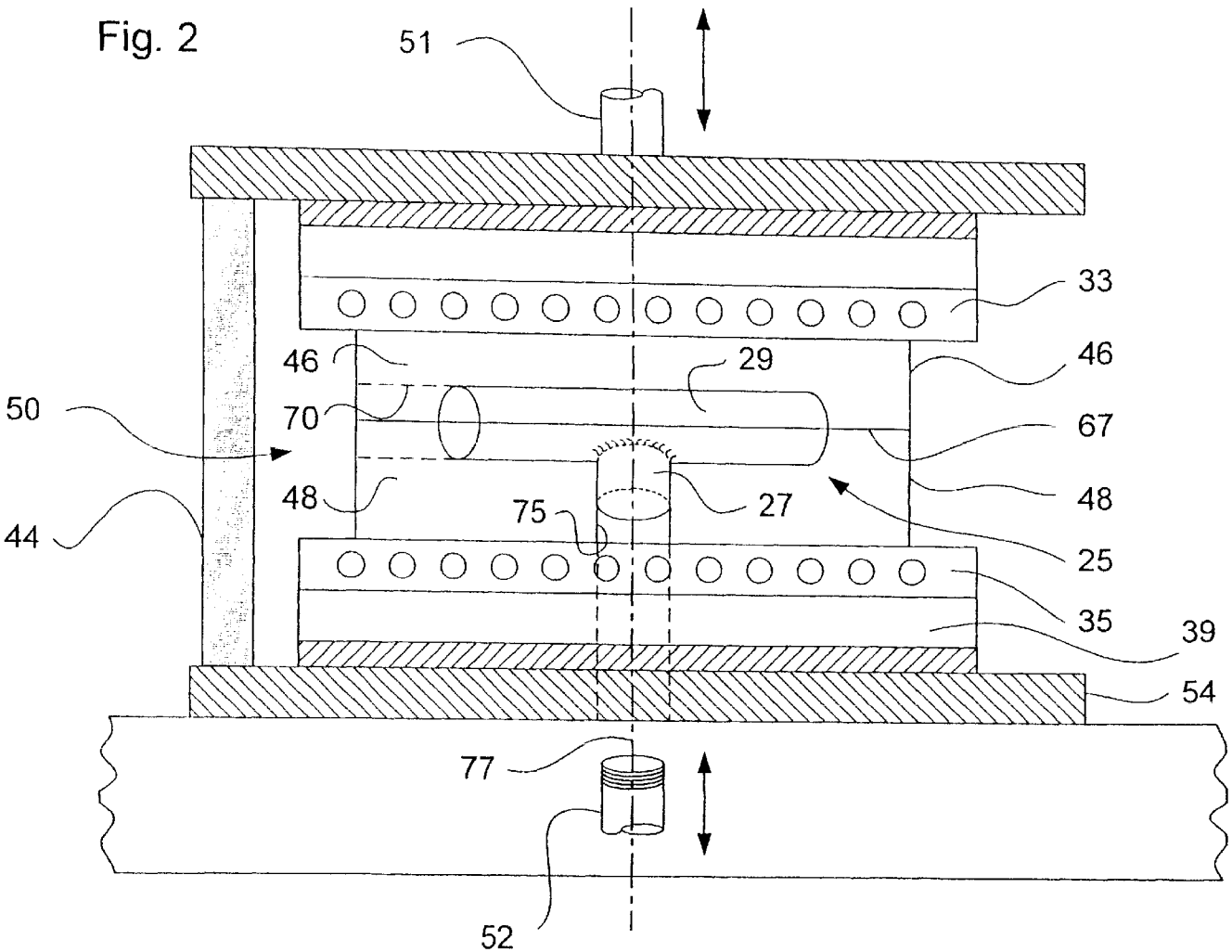
FIG. 2 is a partial sectional elevation of the enclosure shown in FIG. 1, shown with the die in place and holding a tube from which an integral pullout has been superplastically formed.

Turning now to the drawings, wherein like reference numerals designate identical or corresponding parts, and more particularly to FIGS. 1 and 2, an automated apparatus for forming a tubular part 25 having a tubular pullout 27 on a tube 29 in accordance with this invention is shown having an insulated enclosure 30 enclosing an open interior space 32 containing top and bottom heated platens 33 and 35 supported at the top and bottom of the enclosure 30 on insulated ceramic refractory slabs 37 and 39. The enclosure 30 is similar to a conventional superplastic forming press, but it does not need or have the powerful hydraulic ram and supporting structures necessary to react the gas pressure forces exerted within the die in the course of conventional superplastic forming operations, so the enclosure is far less costly to build and maintain. Instead, a simple frame (not shown) of conventional design supports the upper components of the apparatus on the base. The platens 33 and 35 are heated by electrical rod heaters with electrical power controlled by a Proportioning, Integrating and Derivative ("PID") three mode controllers 40 in an electrical control cabinet 42. The PID controllers make possible a rapid heating rate on a controlled heating curve that ensures that the designated temperature will be reached quickly without overshooting. An insulated side wall 44 of the enclosure 30 surrounds the enclosed space 32 on three sides. An insulated front door (not shown), movable between open and closed positions, provides access to the enclosed space 32 for inserting and removing top and bottom halves 46 and 48 of a die 50, shown in FIG. 2, in which the tubular part 25 is formed. A die lifter 51 of conventional design is provided for lifting the upper half 46 of the die 50 during insertion of the tube 29 and removal of the formed part after forming.

A vertically oriented pull-rod 52 extends through aligned holes in the base 54 of the enclosure, the bottom insulated slab 39, the lower platen 35, and the die bottom 48. The pull-rod 52 has a proximal end attached to an activation unit 55 powered by a motor 58. In FIG. 1, the proximal end is the bottom end, but the rod could alternatively be arranged to enter the enclosure from the top or sides. The activation unit 55 could be a hydraulic or screw drive, or a servomotor with a gear reduction unit, providing precisely controlled vertical displacement of the rod 52 under the power of the motor 58, controlled by a programmable controller 60, which also controls the operation of the PID controllers. The position and line of action of the activation unit 55 can be moved to provide off-center and non-vertical lines of action for the pull-rod 52, for applications described later below.

Figure 3:
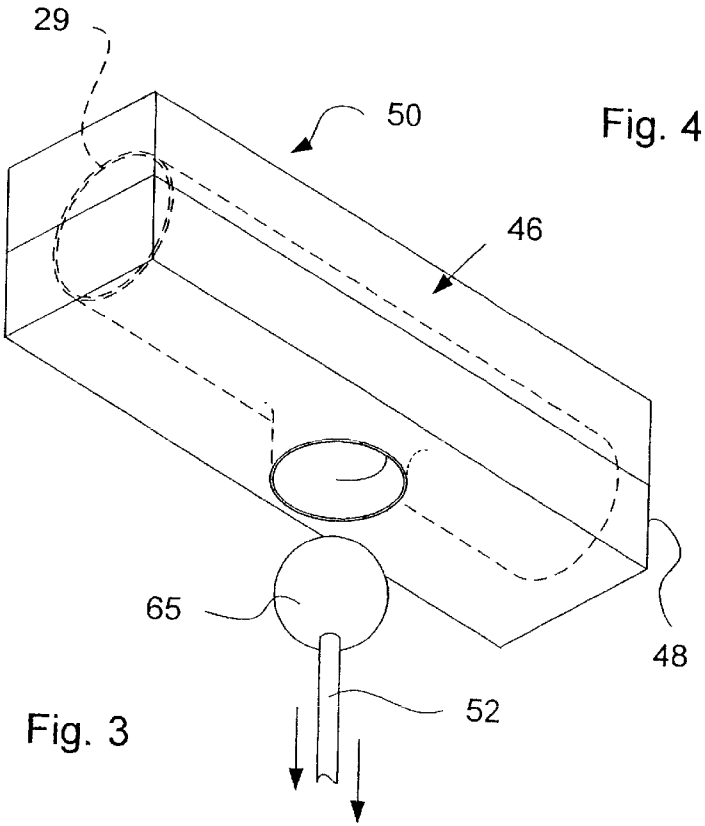
FIG. 3 is a perspective view, from below, of a die set used in the apparatus of FIGS. 1 and 2 to perform the process of this invention.

A pull die, represented in FIGS. 1 and 3 as a ball 65, is removably attached to a distal end of the rod 52, shown in FIG. 1 as the top end. The ball 65 is the forming die by which the material of the side wall of the tube 29 is formed into the tubular pullout 27.

Figure 6:
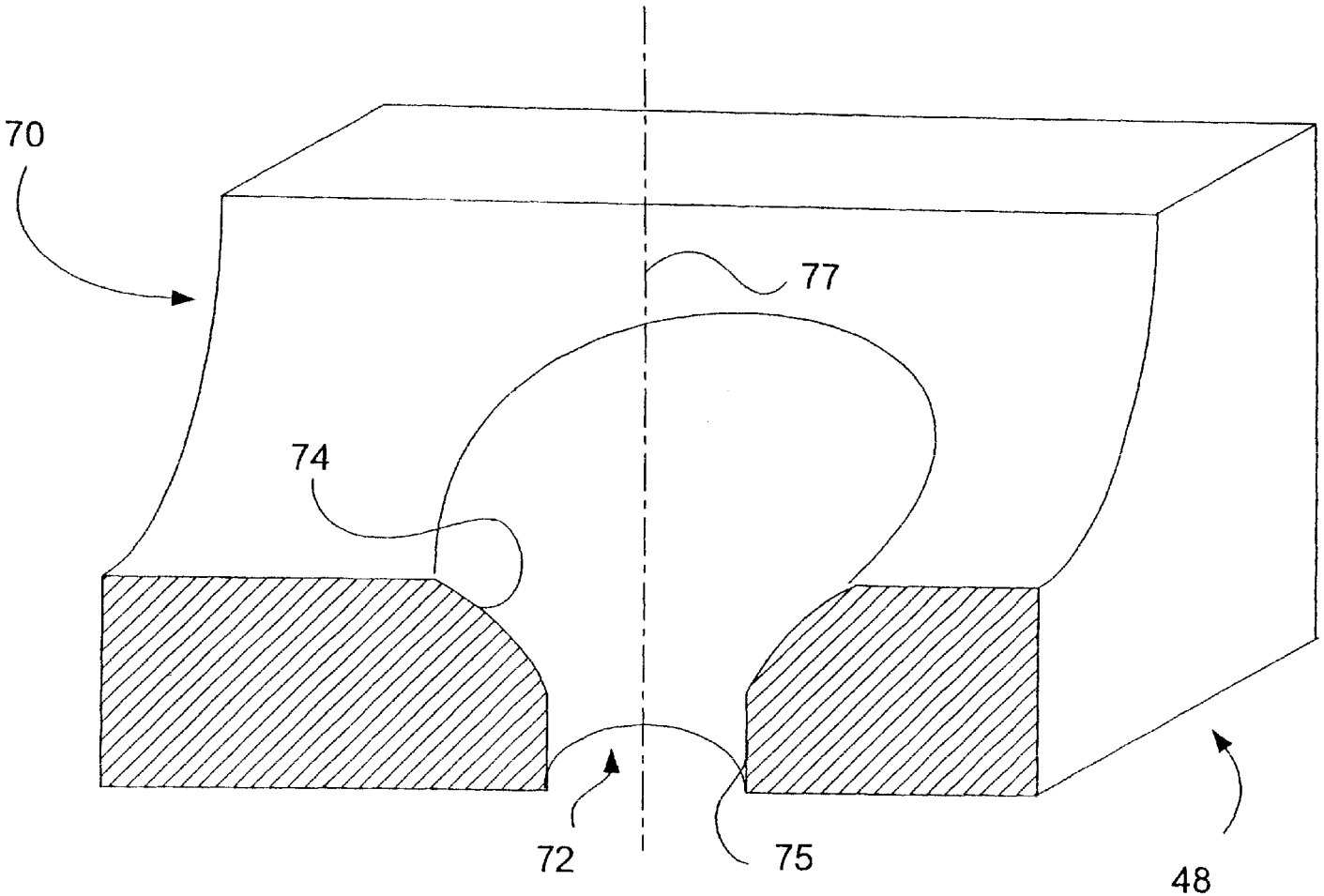
FIG. 6 is a sectional perspective view of the lower die half shown in FIGS. 2 and 3.

The die 50 is split along a horizontal center plane 67 through the axis of a cylindrical cavity 70 sized to receive the tube 29 with a snug fit. As shown in FIG. 6, the die lower half 48 has an opening 72 with a flaring lead-in portion 74 providing a draw radius, tapering to a cylindrical bore 75 on a vertical axis 77 intersecting the horizontal axis of the cylindrical cavity 70 and having an internal diameter equal to the desired outside diameter of the pullout 27. The vertical axis 77 of the bore 75 coincides with the axis and line of action of the rod 52 when pulled by the activation unit 55.

Referring again to FIG. 1, the opening 79 in the lower platen 35 and the insulated slab 39 is of sufficient diameter to receive the rod 52 and also the pull die 65 when it is retracted by the activation unit 55. The activation unit may be provided with sufficient range to pull the pull die 65 all the way out of the enclosure 30 so that it may be conveniently disconnected from the rod 52 directly without the use of remote manipulators, as described below.

In operation, the upper and lower die halves 46 and 48 are preheated to superplastic forming temperature by contact with the platens 33 and 35 heated with the rod heaters under control of the heater controllers 40. The upper die half is lifted by the die lifter 51 and a tube 29, having a pre-cut hole 80 through the side wall, is inserted into the lower die half 48, with the center of the hole 80 aligned with the vertical bore 75 in the lower die half 48, which in turn is aligned with the opening 79 in the lower platen 35 and insulated slab 39. The die 50 is closed by lowering the upper die half 46 onto the lower die half 48. In some applications, the upper die half 46 may be omitted.

The tube 29 is made from a metal such as titanium 6-4 alloy, which has superplastic properties. Superplastic properties include the capability of the metal to develop unusually high tensile elongations and plastic deformation at elevated temperatures, with a reduced tendency toward necking or thinning. The characteristics of superplastic forming and diffusion bonding are now reasonably well understood, and are discussed in detail in U.S. Pat. No. 3,927,817 to Hamilton, U.S. Pat. No. 4,361,262 to Israeli, and U.S. Pat. No. 5,214,948 to Sanders. The diffusion bonding properties are important only in connection with the embodiment illustrated in FIGS. 35–39 and discussed in detail below.

The rod 52 is extended upward, with its axis coincident with the aligned axes 70 of the opening 79 in the lower platen 35, the vertical bore 75 in the lower die half 48 and the hole 80 in the tube 29. A pull die 65, preheated by induction heating or the like to superplastic forming temperature, is inserted from the side into the center of the tube 29 and positioned in alignment with the axis of the rod 52 using a manipulator arm (not shown) of conventional design. The rod 52 is advanced and rotated about its axis to engage the threads on the distal end of the rod 52 with corresponding threads in an internally threaded hole in the pull die 65. The tube 29 is heated in the die 50 to the desired superplastic forming temperature, and the pull die 65 may also be heated by electrical resistance heaters energized by electrical conductors in the rod 52 if it was not heated before attachment to the rod 52.

When the tube 29 and the pull die 65 are at superplastic forming temperature, about 1650° F. for titanium 6-4 alloy, the motor 58 of the activation unit 55 is energized to pull the pull die 65 through the hole 80 in the tube 29 at a controlled rate. The speed of the activation unit 55 is precisely controlled to pull the pull die 65 at a rate that strains the tubing material at a predetermined rate. Hence, it is advisable to quantify the flow of material around the forming radius at the junction of the tube and the pullout 27 using engineering analysis, such as finite element analysis, to determine the speed at which the pull die 65 is pulled through the hole. The rate that the activation unit 55 pulls the die 65 through the hole is measured by a linear encoder and the motion is precisely controlled during the forming cycle to account for changes in the geometry of the tube in the area adjacent to and within the pullout 27. The activation unit 55 has a programmable logic controller, either in the activation unit itself or in the control console 60, which provides feedback and control to the motor 58 in the activation unit by which the pull die rod 52 is pulled at a precisely controlled rate. The engineering analysis, such as finite element analysis, by which the flow of material around the forming radius is quantified, provides an idealized linear speed schedule to program the linear actuator to match the optimal superplastic strain rate of the tube material.

Figure 9:
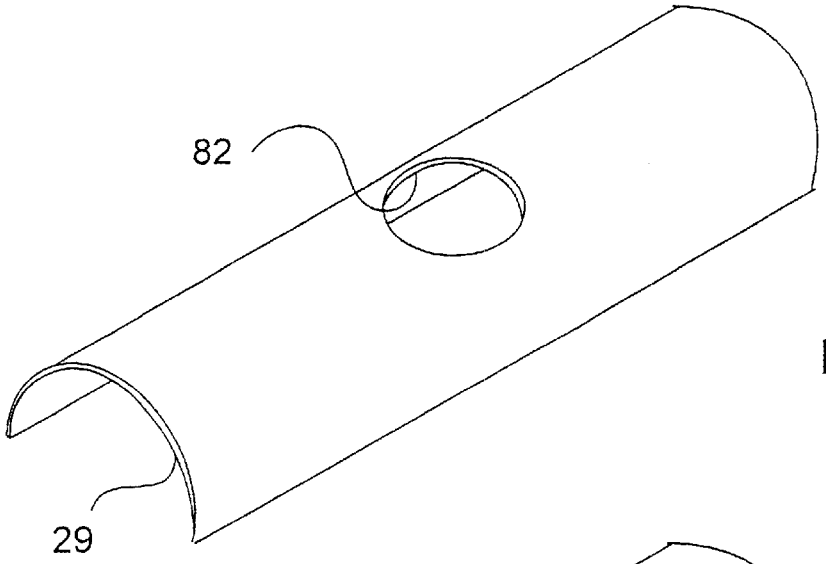
FIGS. 7–9 are perspective views of three tubes, only half of each shown for clarity, showing three different shapes of openings through which the pull-die can be pulled to form the pullout of this invention.
Figure 7:
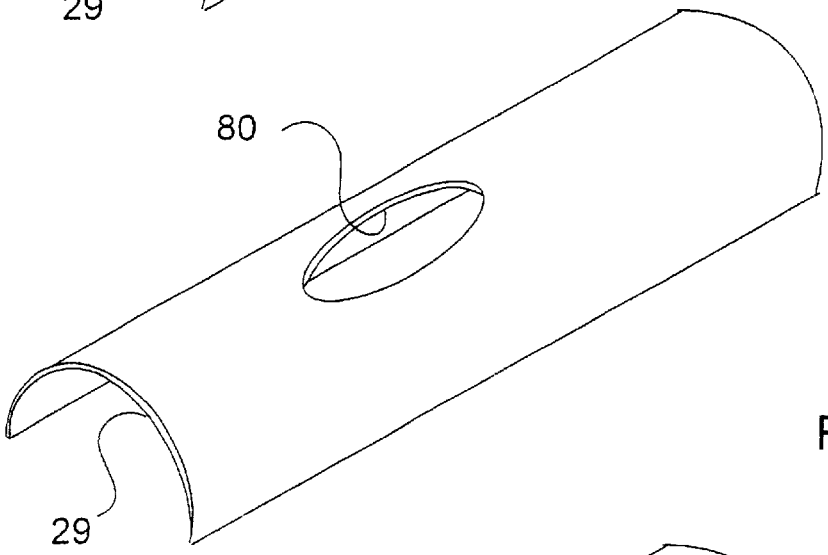
Figure 8:
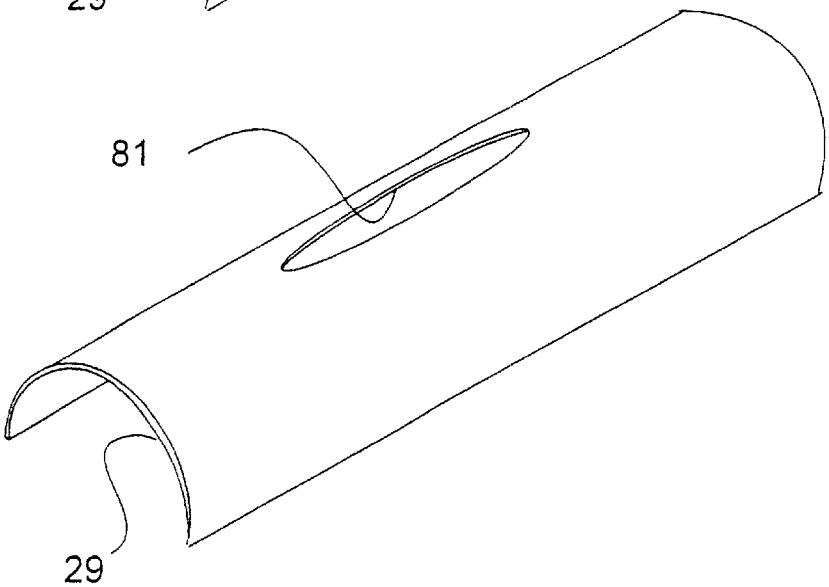

As shown in FIGS. 7–9, the hole 80 can be made in various shapes, depending on the conditions. The best shape for a right angle pullout having an internal diameter equal to the internal diameter of the tube 29 (shown in FIGS. 7–9 as half tubes for clarity of presentation) is an oval hole as shown in FIG. 7. The narrow elongated hole 81 shown in FIG. 8 is best for elbows, pullouts, and material having exceptional super-elastic elongation capabilities. The round hole 82 shown in FIG. 9 is appropriate for material having poor elongation capabilities and for the diffusion bonding embodiment discussed below.

Figure 10:
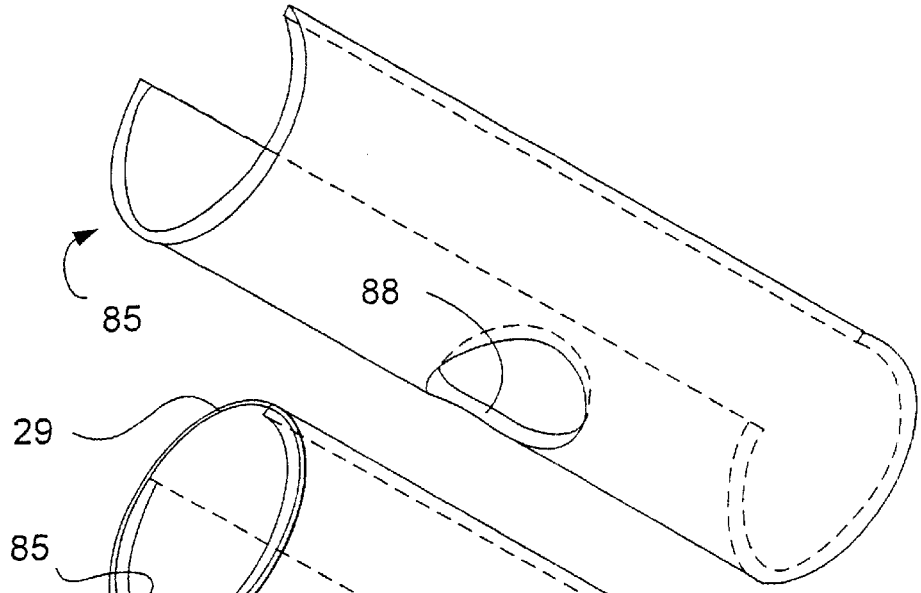
FIG. 10 is a perspective view of a retaining tube used to support the tube during formation of the pullouts in the process of this invention.
Figure 11:
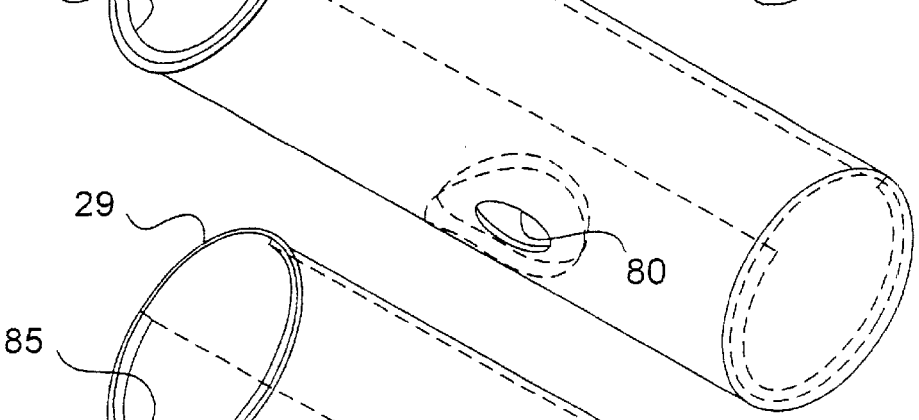
FIGS. 11 and 12 are perspective views of the retaining tube shown in FIG. 10 in the tube in the apparatus shown in FIG. 2 in the pre-formed and post-formed conditions, respectively.
Figure 12:
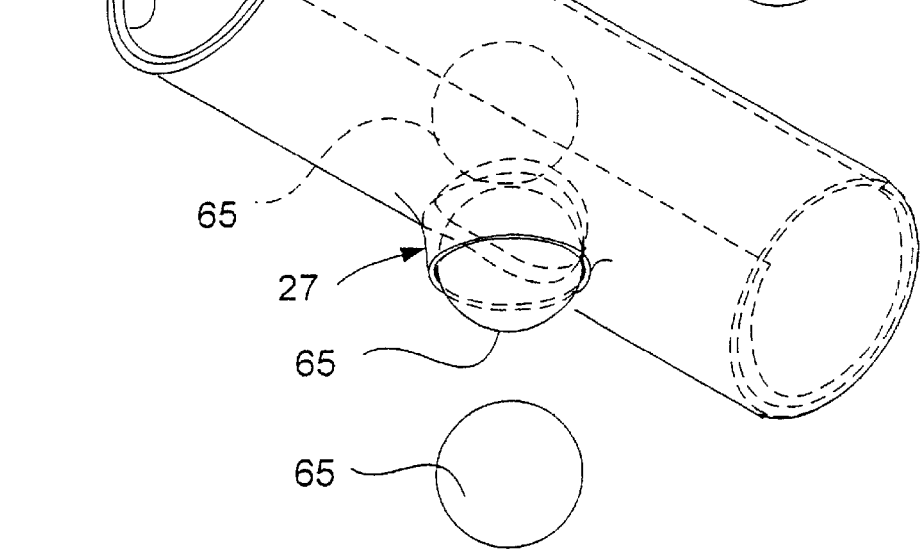

The tensile stresses developed in the tube 29 as the pull die 65 is pulled through the hole 80 can be great enough in some materials to pucker the tube material circumferentially adjacent to the pullout 27. To support the tube sidewall against such puckering, a retaining sleeve 85, shown in FIGS. 10–12, is inserted into the tube 29 to hold the tube material against the sides of the die cavity 70. A hole 88 in the retaining sleeve 85 is large enough to pass the pull die 65, and the tube material around the hole 88 is sufficient to form the pullout 27. The retaining sleeve 88 may be a partial cylinder as shown in FIGS. 10–12, or it may be a complete cylinder. Preferably, the retaining sleeve 85 is high temperature, corrosion resistant, tool steel with a suitable release coating to prevent adhesion to the tube 29. The steel material of the retaining sleeve 85 has a higher coefficient of thermal expansion than the titanium material of the tube 29, so the steel retaining sleeve expands to hold the tube firmly between it and the die cavity surface 70. When the formed part 25 is removed from the die cavity 70 and cools, the steel retaining sleeve 85 contracts more than the tube 29, and the retaining sleeve 85 can be removed easily from the formed part 25.

EXAMPLES

A tube of titanium 6-4 alloy (6 aluminum, 4 vanadium, balance titanium, Mil-T-9046J, type AB-1) having an internal diameter of 10 inches and a wall thickness of 0.041 inches is selected. An oval hole 80 having a major axis 7 inches long and a minor axis 3 inches long is cut in the sidewall of the tube, with the major axis extending parallel to the longitudinal axis of the tube. The tube 29 is inserted in the lower half 48 of a die made of a suitable die material such as cast ceramic as disclosed in U.S. Pat. No. 5,467,626, or corrosion resistant tool steel such as ESCO 49-C or Hayne's Alloy HN. The die half 48 has a pullout opening 72, shown in FIG. 6, having a curved draw radius 74 that tapers in a smooth curve to a cylindrical bore 75. The tube 29 is positioned with the center of the oval hole 80 aligned with the axis of the bore 75 in the die half 48. Alignment is by alignment pins or the like in the die cavity engaging holes and/or slots in trim portions of the tube 29.

Figure 13:
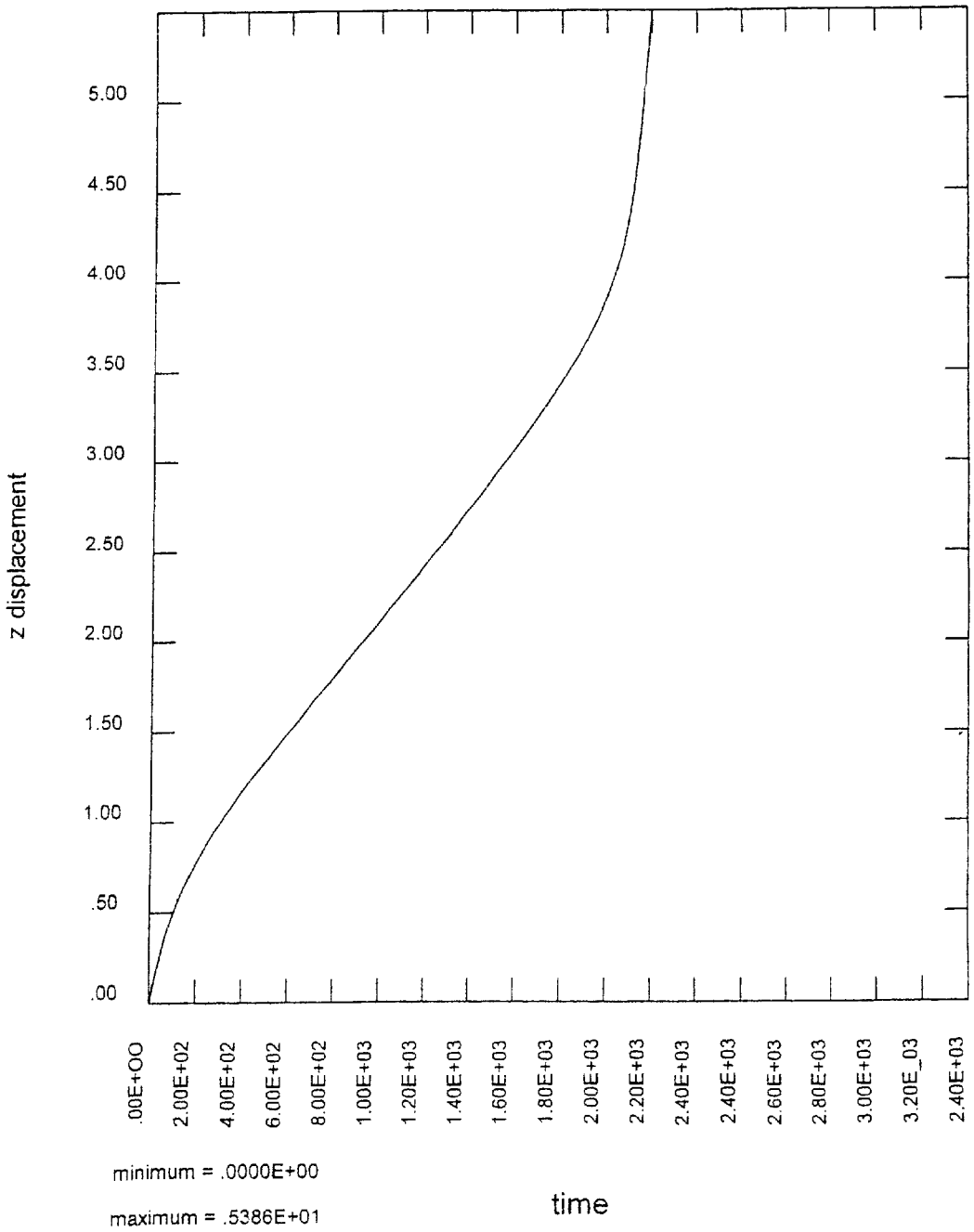
FIG. 13 is a graph showing a representative forming schedule to form the part shown in FIG. 14.
Figure 14:
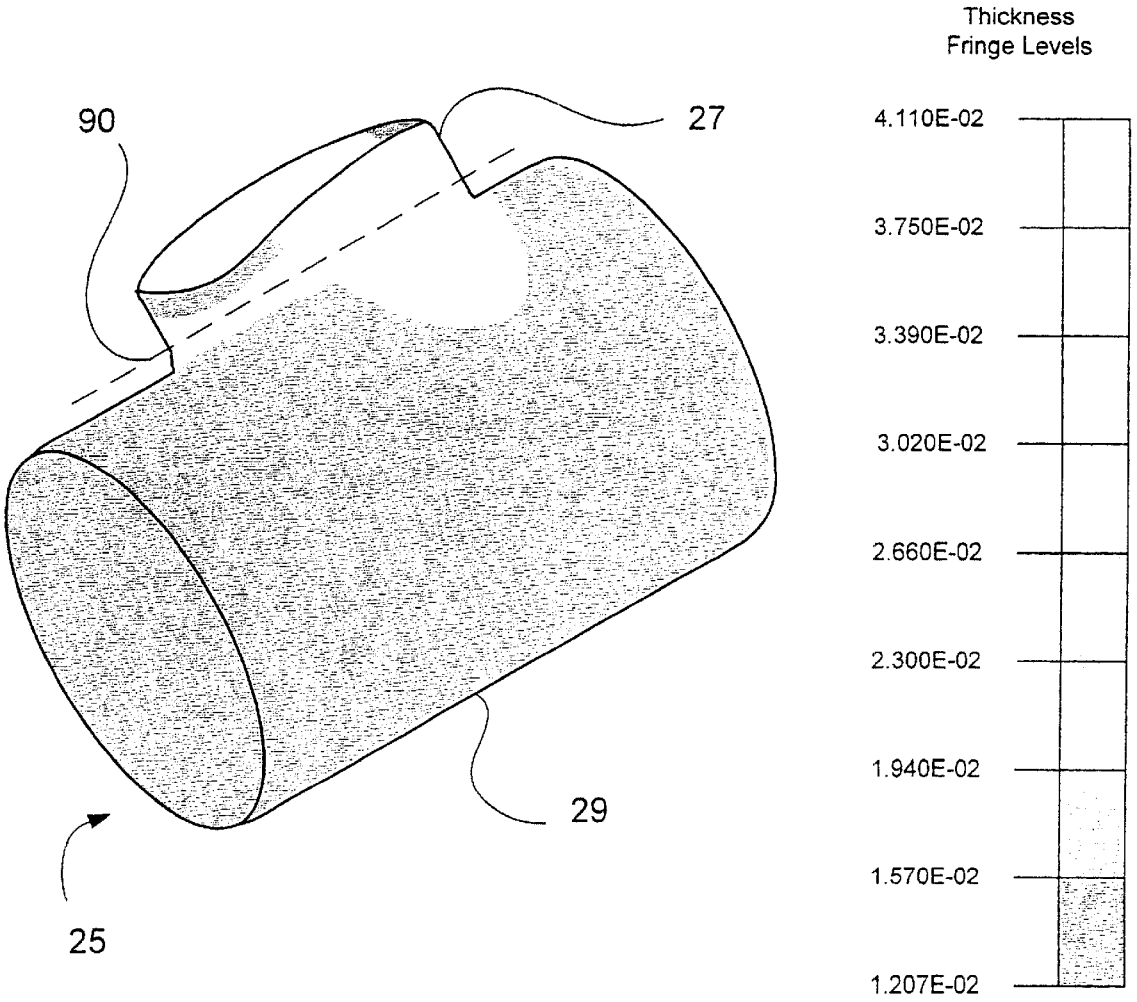
FIG. 14 is a perspective view of a part formed in accordance with this invention.

The pull die 65 is pulled through the hole 80 on a pull schedule graphed in FIG. 13. The pull rate is initially about 0.5 inches/minute, but slows gradually to about 0.2 inches/minute in the intermediate portions of the cycle. The pull rate is then increased to nearly the same as the initial pull rate. This pull rate schedule produces an optimal strain rate of about $2\times10^{-4}$ $sec^{-1}$ for the material in the marginal regions around the hole 80. The resulting part 25, shown in FIG. 14, has a thickness at the trim line 90 that is about 0.030" which is more than 70% of the original thickness of the tube 29.

Figure 15:
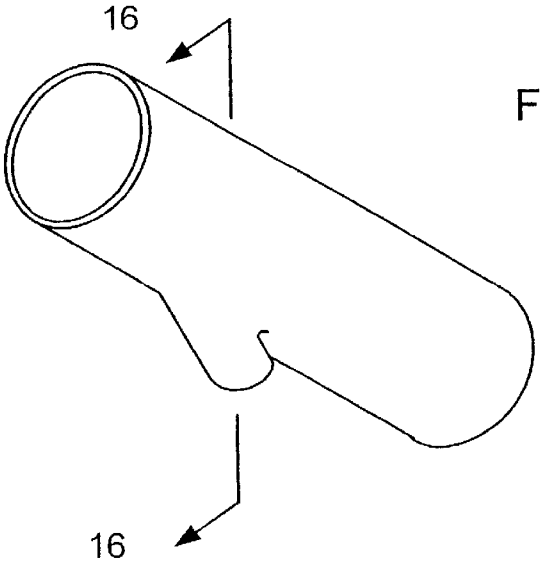
FIG. 15 is a perspective view of a part having a pullout on an oblique angle formed in accordance with this invention.
Figure 16:
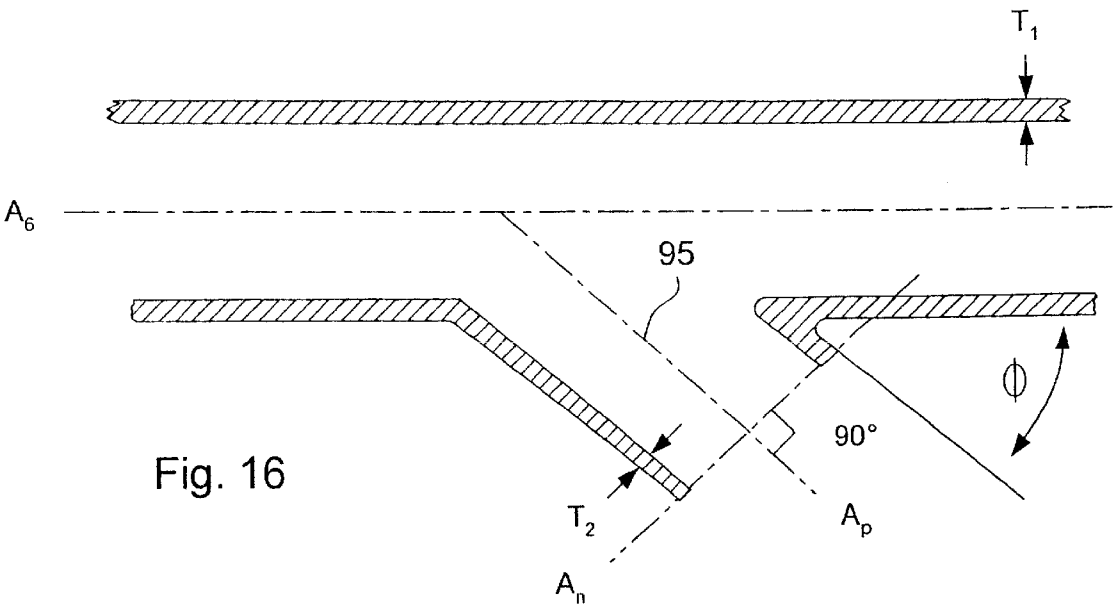
FIG. 16 is a sectional elevation along lines 16—16 in FIG. 15.
Figure 19:
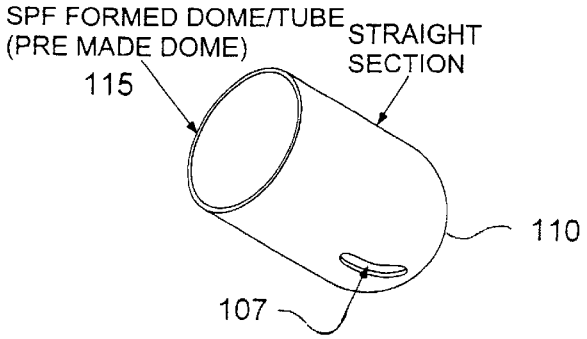
FIG. 19 is a perspective view of a domed-end preform used to make the part shown in FIG. 17.
Figure 17:
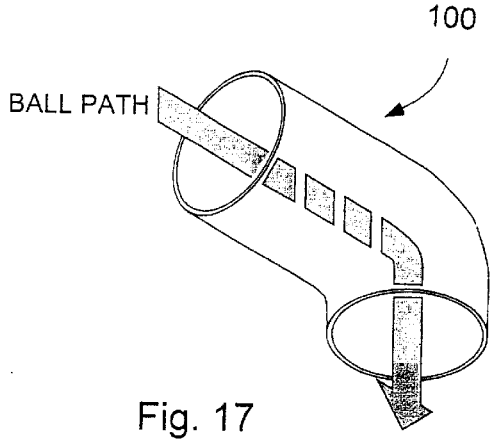
FIG. 17 is a perspective view of an elbow formed in accordance with this invention.
Figure 20:
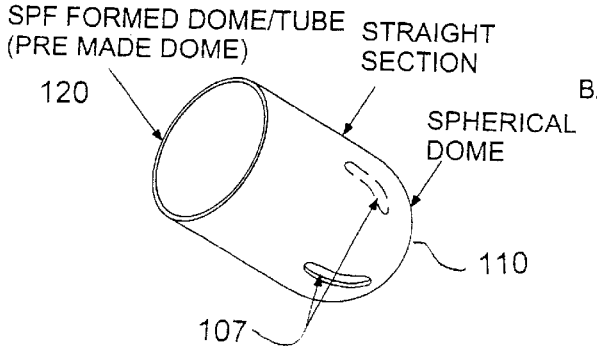
FIG. 20 is a perspective view of a preform used to make the part shown in FIG. 18.
Figure 18:
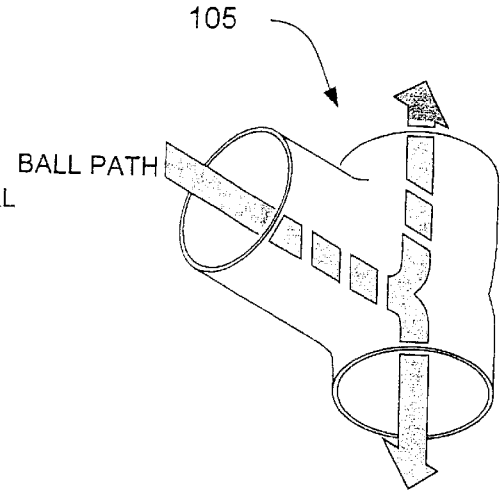
FIG. 18 is a perspective view of a tee formed in accordance with this invention.

Other types of parts may be made using this same process or slight modifications thereof. For example, angled pullouts of the type shown in FIGS. 15 and 16 are made using a die set having an angled opening. The activation unit 55 is moved laterally and the line of action of the pull-rod 52 is aligned with the axis 95 of the angled opening in the die. Preferably, the pull-rod 52 is guided to ensure that it moves straight into the opening along the axis 95 thereof. Elbows 100 and tees 105 may be made as shown in FIGS. 17 and 18 using a heated pull die pulled through one or two oval holes or slots 107 in a closed end portion 110 of closed-end tubes 115 or 120, shown in FIGS. 19 and 20, made of superplastic material as described above.

Figure 21:
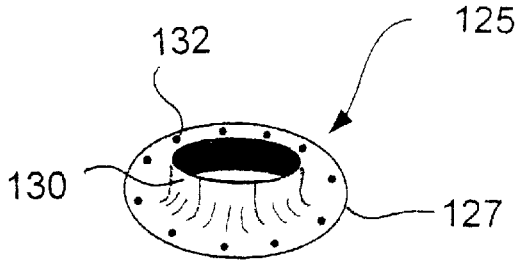
FIG. 21 is a perspective view of a round planform flange formed in accordance with this invention.

Formed flanges of any desired planform and base curvature, from flat to compound curvature, can be made using tooling described below. The formed flanges are generally for the purpose of attaching a tubular part such as a duct to a structure that receives or delivers a fluid supply through the duct. A flange 125 is shown in FIG. 21, having a flat base 127 and an upstanding pullout 130 with a round planform 130 for attachment to a duct or other tubular structure. A plurality of holes 132 is drilled in the base 127 for attachment to the structure to which the flange is to be connected.

Figure 23:
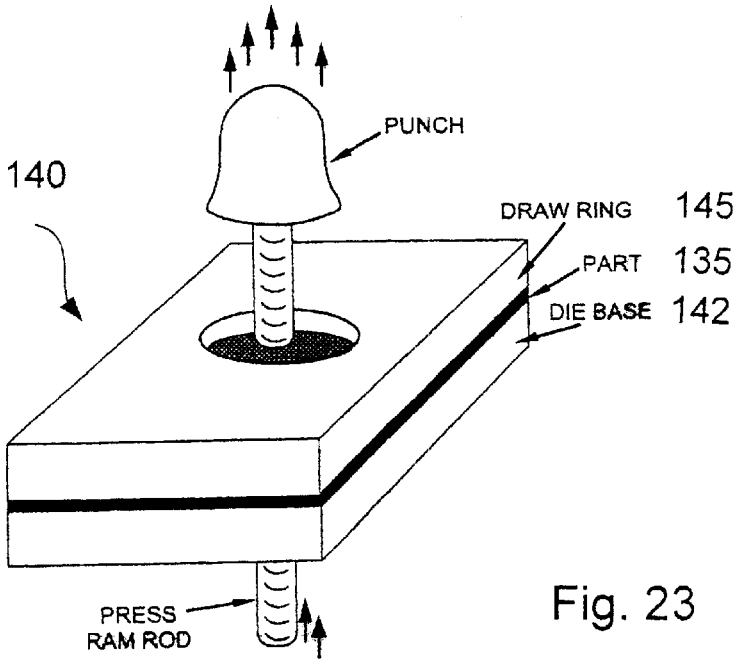
FIG. 23 is a perspective view of a tooling set in which the sheet shown in FIG. 22 is formed.
Figure 22:
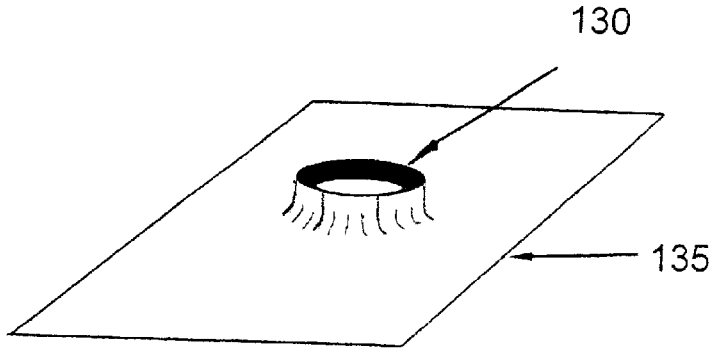
FIG. 22 is a perspective view of a sheet from which the flange shown in FIG. 21 is cut.
Figure 25:
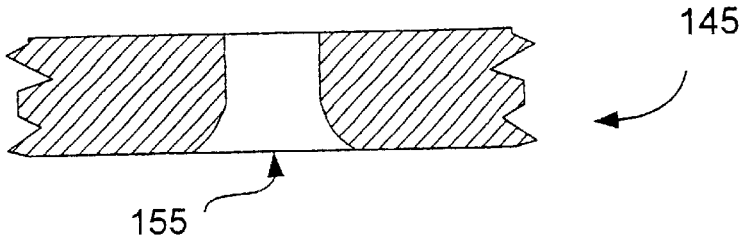
FIG. 25 is a sectional elevation of the draw ring along lines 25—25 in FIG. 24.
Figure 24:
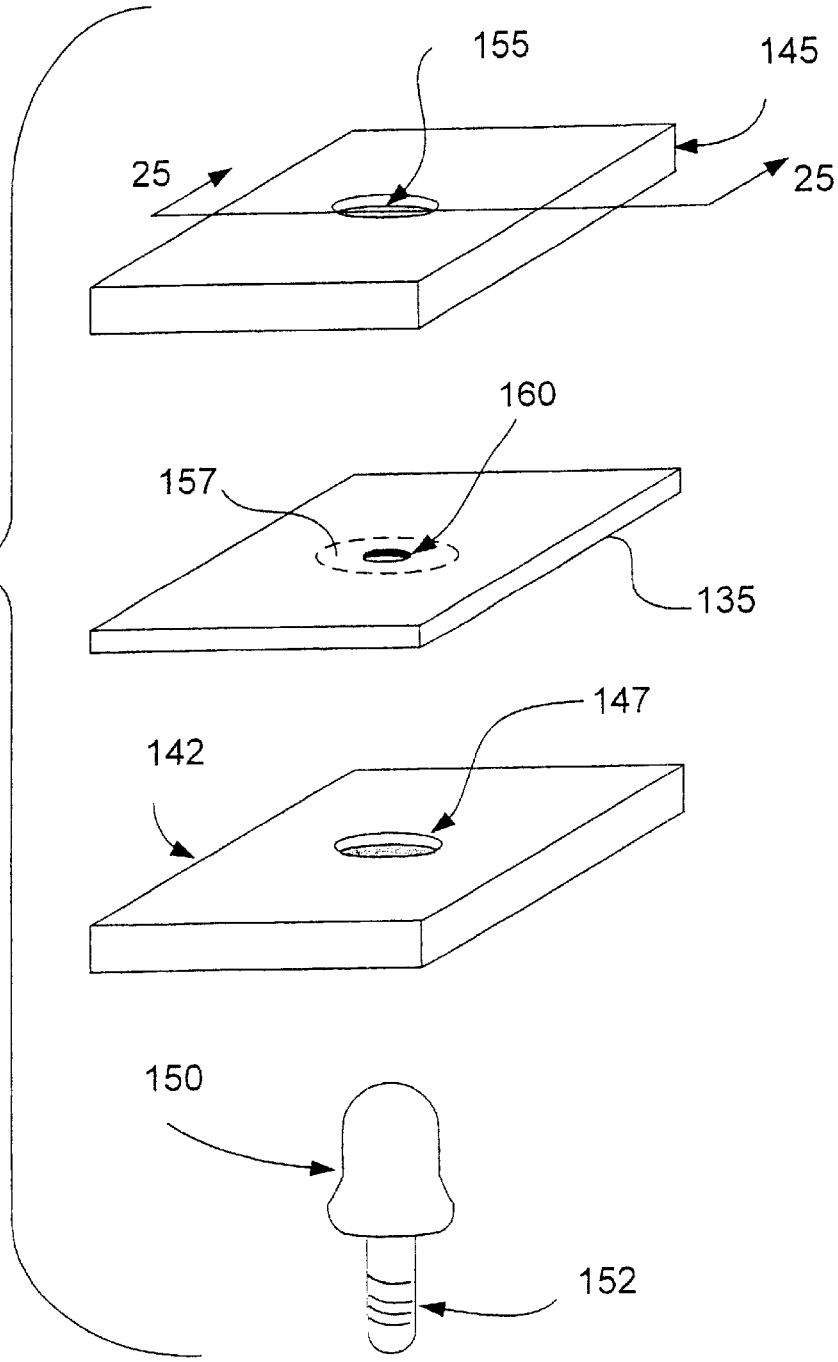
FIG. 24 is an exploded perspective view of the tooling set shown in FIG. 23.

The flange 125 is cut out of a sheet 135 shown in FIG. 22 in which the pullout 130 is formed by an apparatus 140, partially shown in FIG. 23 and shown in exploded form in FIG. 24. The apparatus 140 includes a die base 142 and a matching draw ring 145 which between them hold the sheet 135 in which the pullout 130 is to be formed. The die base 142 has a central clearance hole 147 sized to receive and pass a punch 150 on the end of a press ram rod 152. The draw ring 145 has a rounded tapering opening 155, shown in FIG. 25, around which the marginal regions 157 of the sheet around a central hole 160 are formed into the pullout 130 when the punch 150 is pressed into and through the hole 160. The die base 145 and draw ring 145 are supported in an apparatus similar to the apparatus 30 shown in FIG. 1, but including a central opening in the upper platen 33 and the insulating slab 37 to provide clearance for the punch 150 when it emerges from the formed hole in the sheet 135. A manipulator (not shown) of known construction is mounted above the enclosure for griping and removing the punch 150 from the ram rod 152 after the forming operation.

The process of forming the flange 125 of FIG. 21 starts with cutting the central hole 160 in the sheet 135. In this example, the sheet is titanium 6-4 alloy 0.060 inches thick and the hole 160 is circular and one inch in diameter. The die set comprising the die base 142 and the draw ring 145 is installed in the enclosure apparatus and is heated to superplastic forming temperature for the sheet material, or about 1750° F. for the titanium 6-4 material. The die set is opened and the sheet is inserted onto the die base 142 with the central hole 160 of the sheet 135 aligned coaxially with the clearance hole 147 in the die base 142 and the rounded tapering opening 155 in the draw ring 145. Suitable stops or alignment pins may be attached to or machined in the die base 142 to facilitate such alignment. A mushroom-shaped punch 150 shown in FIGS. 23 and 24 is attached to the ram rod 152 and the punch may be preheated in an induction heater or with internal electrical resistance heaters to shorten the cycle time. When the sheet and the punch are at the desired superplastic forming temperature, the punch 150 is moved with an activation unit (not shown) corresponding to the activation unit 55 shown in FIG. 1 along a line of action coincident with the aligned axes of the openings in the die base 142 and draw ring 145 and the hole 160 in the sheet 135. The punch 150 is moved on a schedule that produces the optimal superplastic strain rate for the material of the sheet 135. Alternatively, the punch can be shaped so that the material of the sheet 135 is strained at the optimal superplastic strain rate when the punch 150 is moved at a constant speed. A punch shape intended for this purpose is indicated in FIGS. 23 and 24 wherein the leading and trailing surfaces of the punch are angled from the axis of the ram rod more steeply than the middle portions of the punch 150.

After the pullout 160 is formed in the sheet 135, the punch is detached from the ram rod 152 by the manipulator, and the ram rod is retracted back through the die set and the formed part. The draw ring 145 is lifted off the die base 142, taking the formed part with it. The part can easily be separated from the draw ring 145 and removed for cleaning and final trimming and drilling of holes 132 to complete the manufacturing steps for the flange 125.

Figure 27:
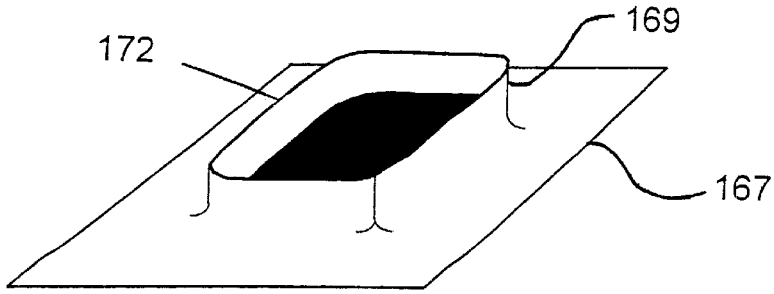
FIG. 27 is a perspective view of a sheet from which the flange shown in FIG. 26 is cut.
Figure 26:
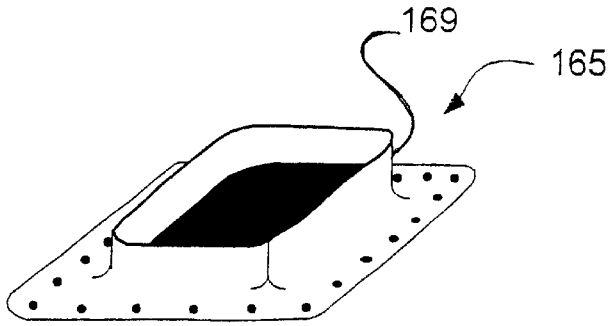
FIG. 26 is a perspective view of a rectangular planform flange formed in accordance with this invention.

The same process used to make the flange 125 shown in FIG. 21 can be used to make a flat, rectangular planform flange 165 shown in FIG. 26 cut from a formed sheet 167 shown in FIG. 27. The apparatus shown in FIGS. 28 and 29 used to form the pullout 169 on the sheet 167 is the same as the apparatus shown in FIGS. 23 and 24 except for the shape of the punch and the openings in the die and draw ring, which have a shape corresponding to the rectangular opening of the flange 165 in FIG. 26. The opening 170 in the sheet 167 (before forming the pullout 169) is shown as oval in shape, but the shape will vary with the shape of the punch, and each pullout shape requires its own analysis to determine he optimal shape so that that enough material is available to form the pullout 169 of the desired size and type of material and that the material is not stretched beyond its superplastic forming limits, and further that the thinout around the lip 172 of the pullout 169 is not excessive. It is noteworthy that the opening 170 is stretched to be much larger during the forming process due to the material being drawn around the punch. This phenomenon reduces the amount of thinning in the pullout 169.

Figures 30, 31:
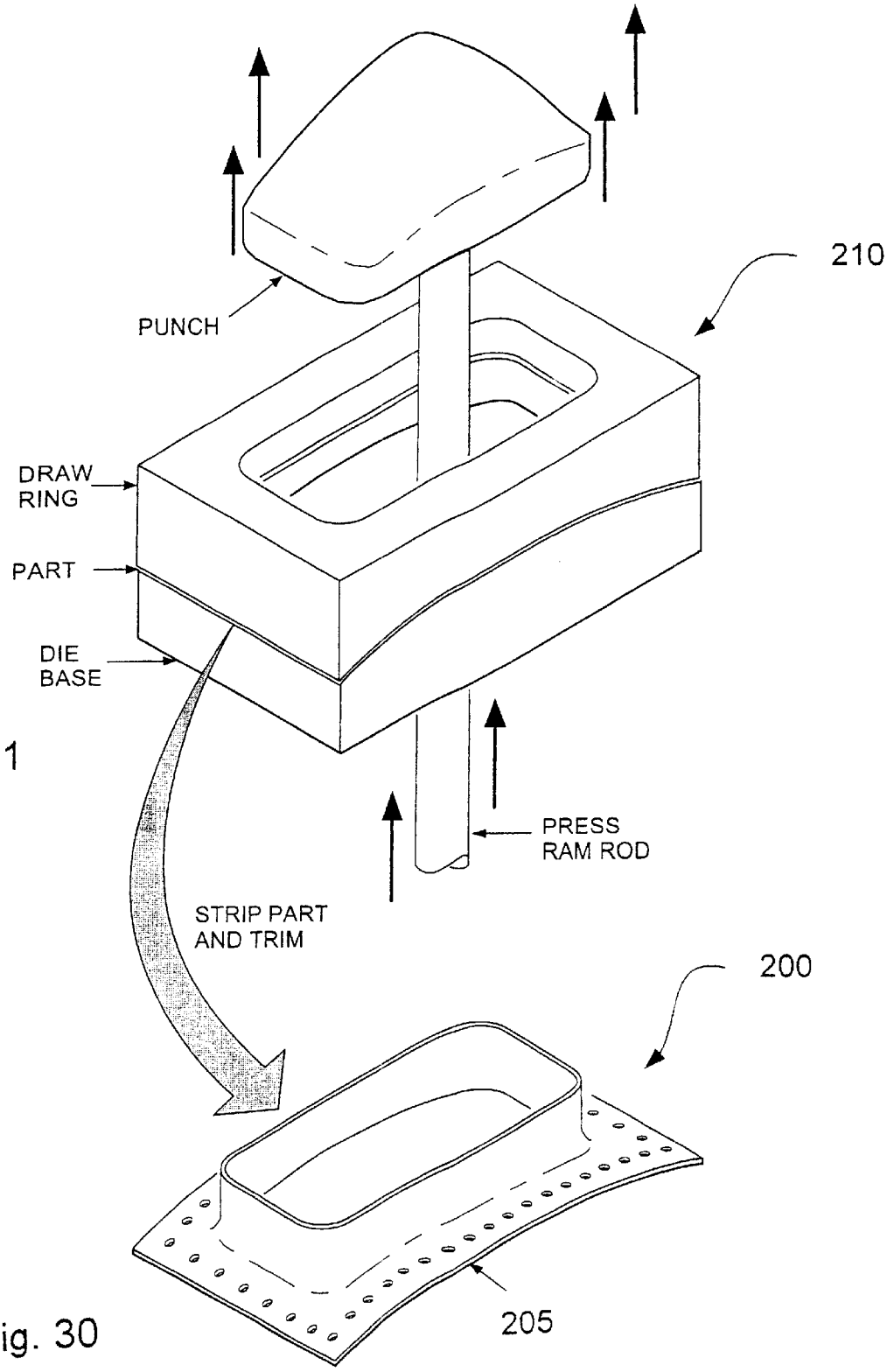
FIG. 30 is a perspective view of a contoured base flange formed in accordance with this invention.
FIG. 31 is a perspective view of an apparatus for forming the part shown in FIG. 30 in accordance with this invention.
Figure 32:
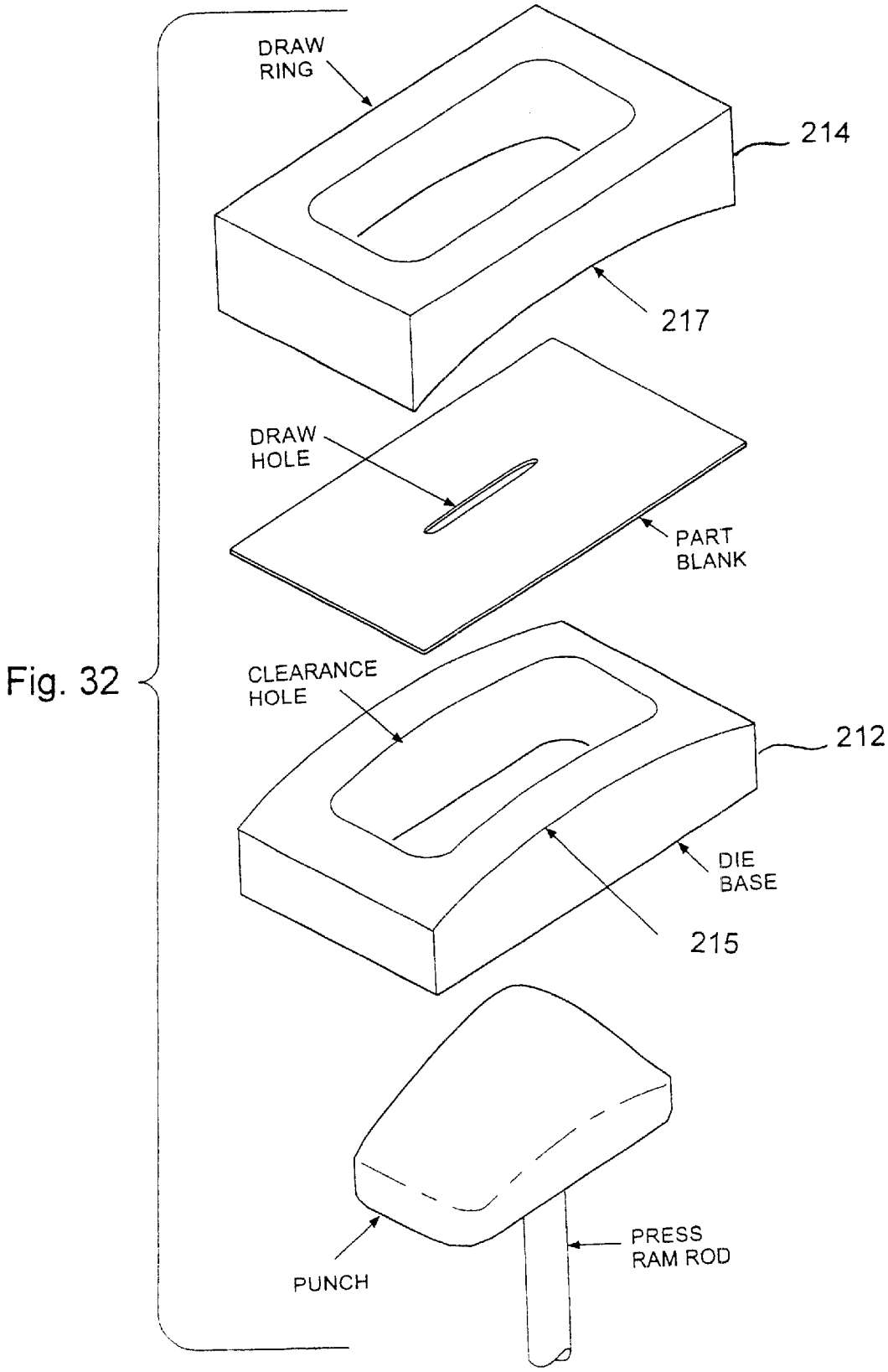
FIG. 32 is an exploded perspective view of the apparatus shown in FIG. 31.

A contoured, rectangular flange 200, shown in FIG. 30, has a base 205 having a simple contour, but could be made with a compound contour instead. The apparatus 210 for forming the flange 200 includes a die base 212 and a draw ring 214 similar to the apparatus shown in FIGS. 28 and 29, except that the mating surfaces 215 and 217 of the die base 212 and the draw ring 214, shown in the exploded view of the apparatus 210 in FIGS. 31 and 32, are shaped with the desired curvature of the flange base 205. The forming process for making the contoured flange 200 is identical to the process used to make the flange 165 shown in FIG. 26.

The flange forming process and apparatus can be modified to produce a reducing flange 230 shown in FIG. 33. The reducing flange 230 has a base 232 like the base of the flange 165 shown in FIG. 26, and an upstanding pullout 234 like the pullout 169 of the part shown in FIG. 26. An integral brim 237 projects partially across the top of the pullout 234, surrounding a central opening 240. A series of holes 242 is drilled in the base 232 and another series of holes 244 is drilled in the brim 237 for attachment to mating structures.

Figure 28:
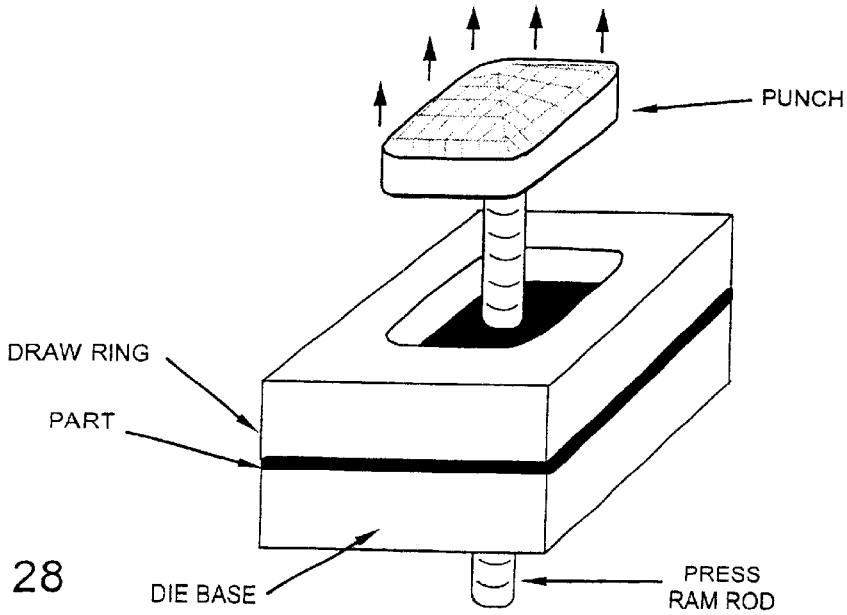
FIG. 28 is a perspective view of an apparatus for forming the sheet shown in FIG. 26.
Figure 29:
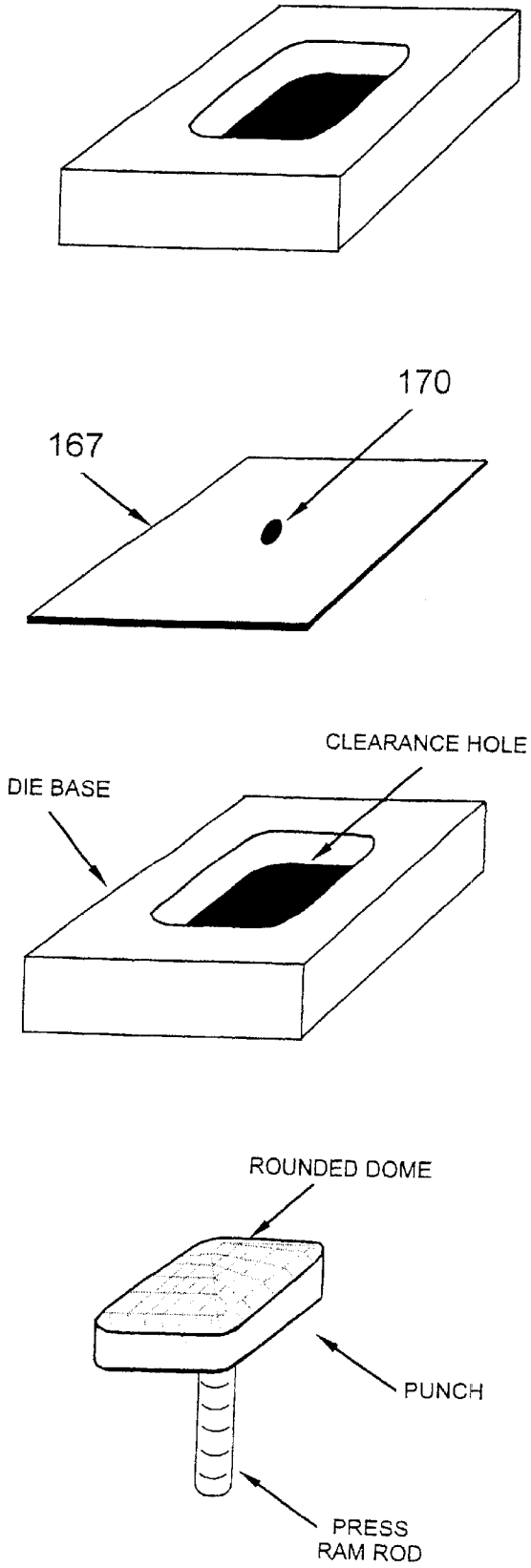
FIG. 29 is an exploded perspective view of the apparatus shown in FIG. 28.

The apparatus for forming the reducing flange 230 is the same as the apparatus shown in FIGS. 28 and 29, or in FIGS. 31 and 32, depending on whether the reducing flange is to have a flat or contoured base. The punch design is different, however. The punch 250, shown in FIG. 34, has a lead-in central projection 252 and a flat shoulder section 254 extending around the projection out to the sides of the punch 250. The flat shoulder section 254 can be shaped to produce any desired contour, parallel or non-parallel to the base 232.

The process for forming the reducing flange 230 is similar to the process used to form the flange 165 shown in FIG. 26, except that the punch 250 is not pushed all the way through the sheet. Instead, the punch is stopped short of full penetration through the sheet, leaving the brim 237 projecting inward. After forming, the part 230 is cooled with a stream of air which causes it to contract around the punch 250. As the part thermally contracts, it is restrained by the punch 250 which causes the part to stretch or plastically deform to slightly larger dimensions relative to the dimensions it would have if it were removed hot from the punch. The stretched part is now reheated by allowing it to sit on the hot punch until it thermally expands enough to allow the punch to move freely out of the pullout 234.

Figure 36:
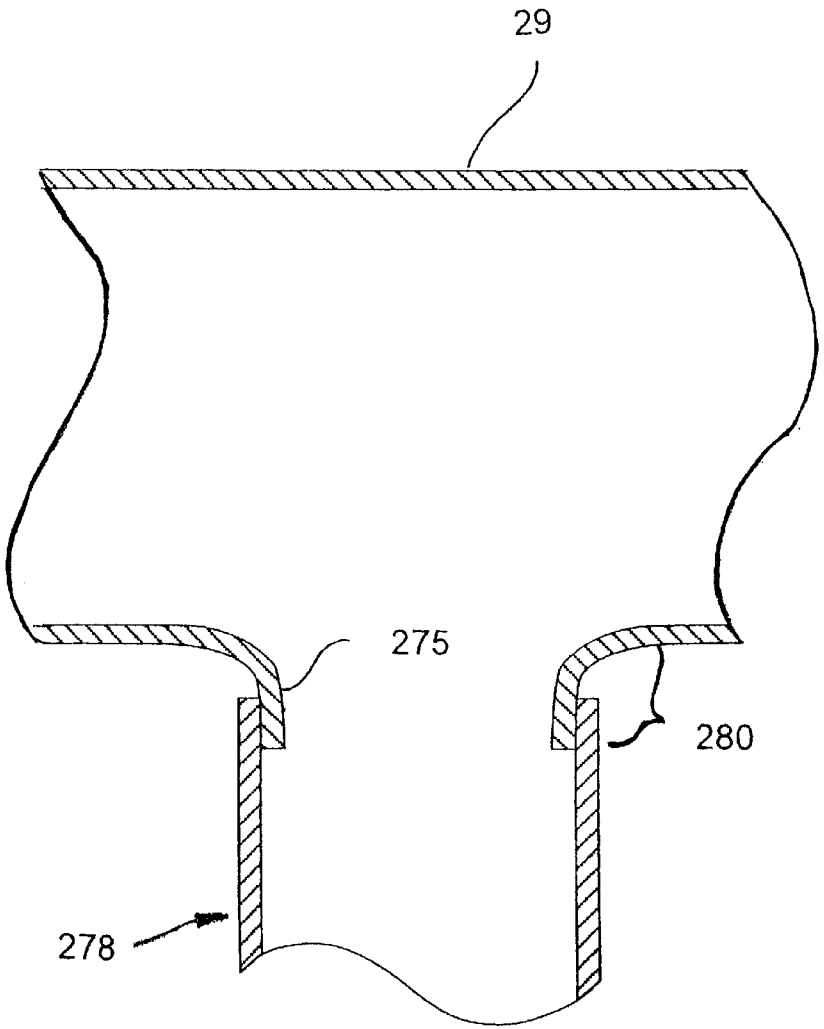
FIG. 36 is a sectional elevation of the superplastically formed, diffusion bonded part along lines 36—36 in FIG. 35.
Figure 35:
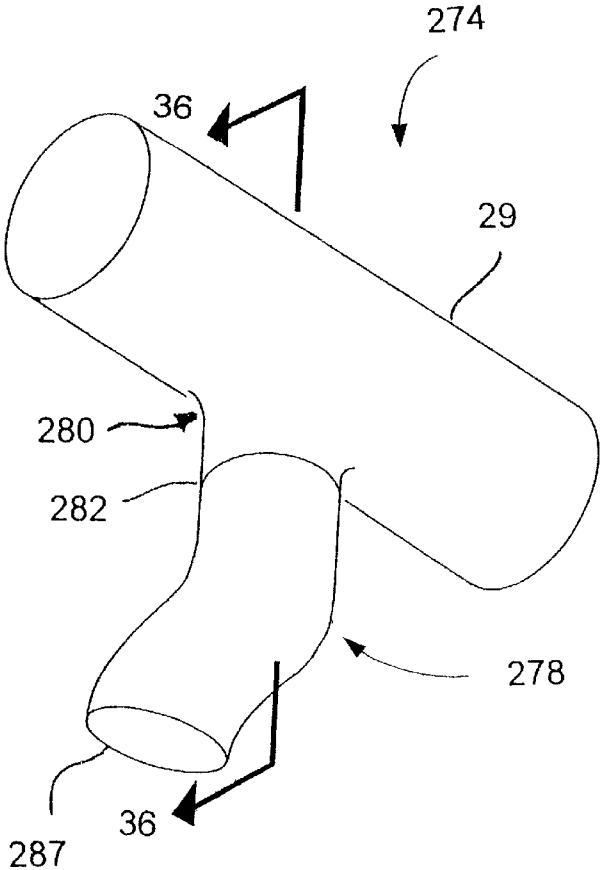
FIG. 35 is a superplastically formed, diffusion bonded part formed in accordance with this invention.

Referring now to FIGS. 35 and 36, another embodiment of the invention is shown wherein a part 274 is made having a partial pullout 275 which is superplastically formed on a tube 29 and is diffusion bonded to a stub tube 278 to form a high strength pullout of any desired lip thickness and with extra wall thickness in the junction radius 280 where stresses tend to be concentrated. This embodiment removes the weld junction 282 from the vicinity of the junction radius 280 and makes quality welds easier to achieve since the lip 287 of the pullout can be made any desired thickness.

Diffusion bonding refers to metallurgical joining of two pieces of metal by molecular or atomic co-mingling at the faying surface of the two pieces when they are heated and pressed into intimate contact for a sufficient time. It is a solid state process resulting in the formation of a single piece of metal from two or more separate pieces without a discernible junction line between them, and is characterized by the absence of any significant change of metallurgical properties of the metal, such as occurs with other types of joining such as brazing or welding.

Figure 37:
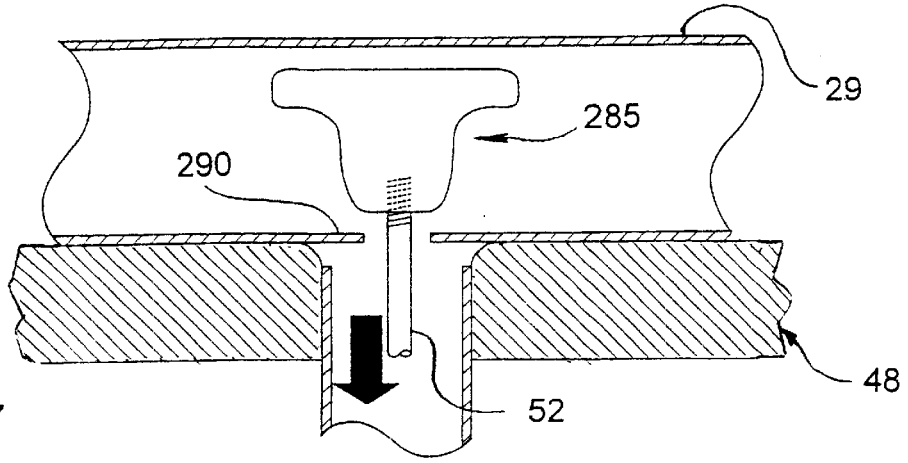
FIGS. 37–39 are sectional elevations of the apparatus and component parts for making the part shown in FIG. 35.
Figure 38:
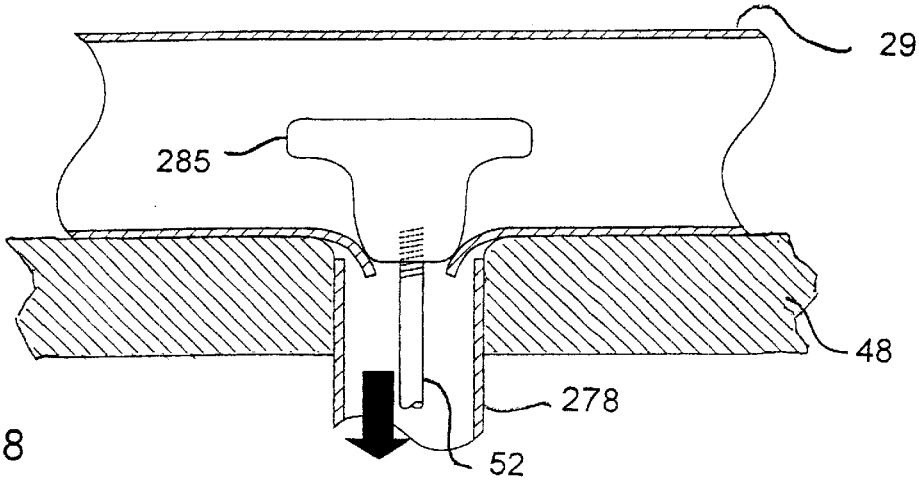
Figure 39:
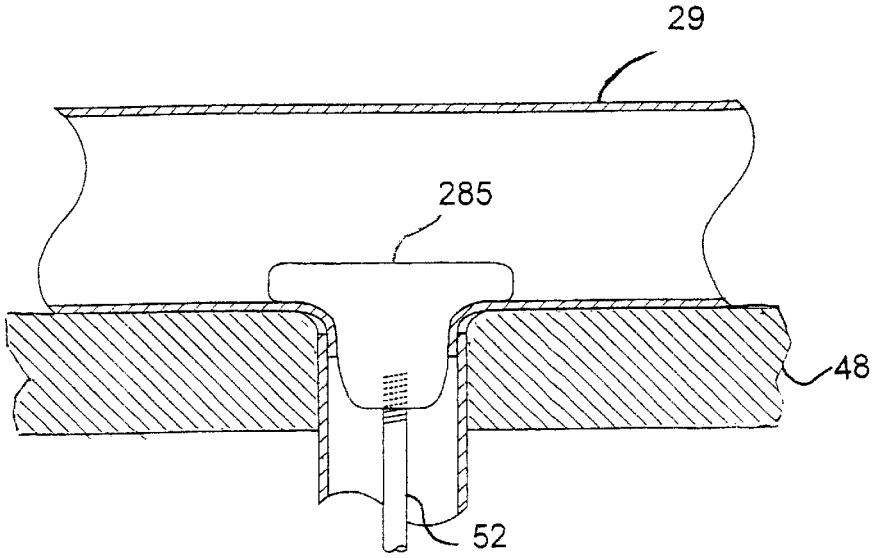

The superplastically formed and diffusion bonded part 274, shown in FIGS. 35 and 36, is made in an apparatus shown in FIGS. 37–39. The part 274 has a short integral pullout 275 formed on a tube 29 with a pull-die 285. The term "integral" as used herein means that the tube 29 and the pullout 275 are of a single piece of metal, not separate pieces attached, connected or joined to make the part. An extension or stub tube 278 is diffusion bonded to the end of the pullout 275 in an overlapping relationship as shown in FIGS. 36 and 39. The thickness of the overlapping region can be made quite thick, as illustrated, without making the other regions of the part unnecessarily thick, so the part is thick where the greatest stresses are encountered and thin elsewhere. The stub tube 278 has a distal end lip 287 that is thick and plane for easy welding into a duct system. The weld region is well removed from the pullout 275 so there is no problem with weakness in the high stress region caused by weld porosity or other weld defects.

The apparatus shown in FIGS. 37–39 for superplastically forming and diffusion bonding (SPF/DB)tubing pullouts of the type shown in FIGS. 35 and 36 includes a die set 50 like the die set used in the embodiment shown in FIGS. 1–6, the lower die half 48 of which is shown in FIGS. 37–39. The pull die 285 of modified form as shown in FIGS. 37–39 is designed to form the pullout 275 and also provide radial pressure to press the pullout 275 against the upper portion of the stub tube 278 and the wall of the opening 72 in the lower die half 48 to achieve a diffusion bond.

In preparation for SPF/DB, the tube 29 and the stub tube 278 are chemically cleaned by immersion, first in an alkaline bath to remove grease and other such contaminants, and then in an acid bath, such as 42% nitric acid and 2.4% hydrofluoric acid to remove metal oxides from the titanium alloy tube 29. The cleaned tubes are rinsed in clean water to remove residues of the acid cleaner, but residues from the rinsing solution may remain on the tube after removal from the rinsing bath. These residues are removed from the tube in the region of the diffusion bonding by wiping with a fabric wad, such as gauze cloth, wetted with a reagent grade solvent such as punctilious ethyl alcohol. The tube is wiped until the gauze comes away clean after wiping. The alcohol evaporates leaving no residue and leaving the tube free of contaminants that would interfere with a complete and rapid diffusion bond when the conditions for such a bond are established.

Titanium and titanium alloys that are to be diffusion bonded must be protected from exposure to oxidizing materials, such as oxygen in the atmosphere, at all times in the process at which the part is heated to a temperature above 700° F., because titanium oxidizes readily above that temperature. For best results, an inert gas, such as welding quality argon, is used as a cover gas to protect the titanium from oxidation attack when the part is hot. The apparatus shown in FIGS. 1, 2, and 37–39 is closed after the pull-die 285 is positioned and attached to the pull-rod 52. The tube 29 and the die set 50 are purged of air and contaminants using dry argon flooding or other known oxygen purging techniques in the diffusion bonding art.

The tube 29 and the stub tube 278 are heated by conductive and radiant heating from the die set 50 and the pull-die 285 is heated by internal electrical heaters, by absorbing radiant heat from the tube, or is preheated before insertion into the tube 29 and attachment to the pull-rod 52, or by some combination thereof. When the tube 29 has reached superplastic forming temperature, the pull-die 285 is pulled down with the pull-rod 52, using an activation unit 55 like the one shown in FIG. 1, and superplastically forms the margin regions 290 around the hole 80 down and outward against the top portion of the stub tube 278, as shown in FIGS. 38 and 39. The pull die 285 is sized to provide radial pressure against the pullout 275 and the overlapping portions of the stub tube 278 to provide sufficient pressure to form a good diffusion bond. If additional pressure is needed, an electrical resistance heater in the pull die 285 can be energized to raise the temperature of the pull-die 285 an additional 10–50° F. to increase its diameter by thermal expansion and increase the interference pressure between the pullout 275 and the stub tube 278. After diffusion bonding is complete, the electrical power to the pull-die 285 is shut off and the die is allowed to cool, or is actively cooled by gas or liquid cooling passages in the pull-die 285 fed from the pull-rod 52. The cooled pull-die 285 contracts away from the diffusion bonded pullout/stub tube and is lifted by the pull-rod 52 and is gripped by the manipulator arm while the pull-rod 52 is rotated and detached from the pull-die 285.

After cooling below superplastic temperature, the part is removed from the die cavity 70 and is recleaned to remove any alpha case that may have formed on the part from high temperature contact with residual air that may not have been purged from the die cavity 70. After cleaning, the part is finished and ready for welding into a duct system without further trimming or other processing.

Figure 4:
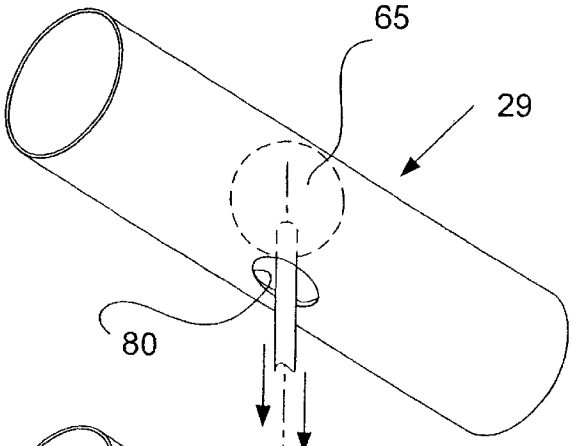
FIG. 4 is a perspective view of a tube as it lies in the die set shown in FIG. 3 prior to forming the pullout, but with the die deleted for clarity.
Figure 5:
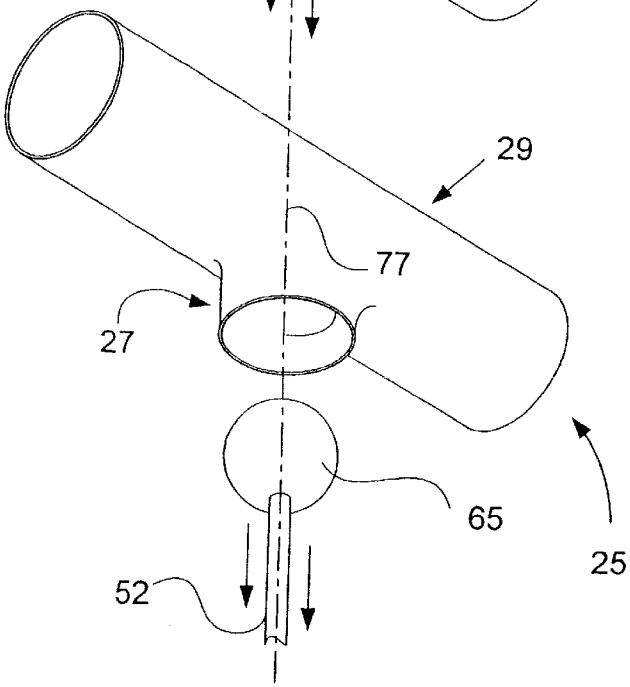
FIG. 5 is a perspective view of the tube shown in FIG. 4 after forming the pullout.
Figure 40:
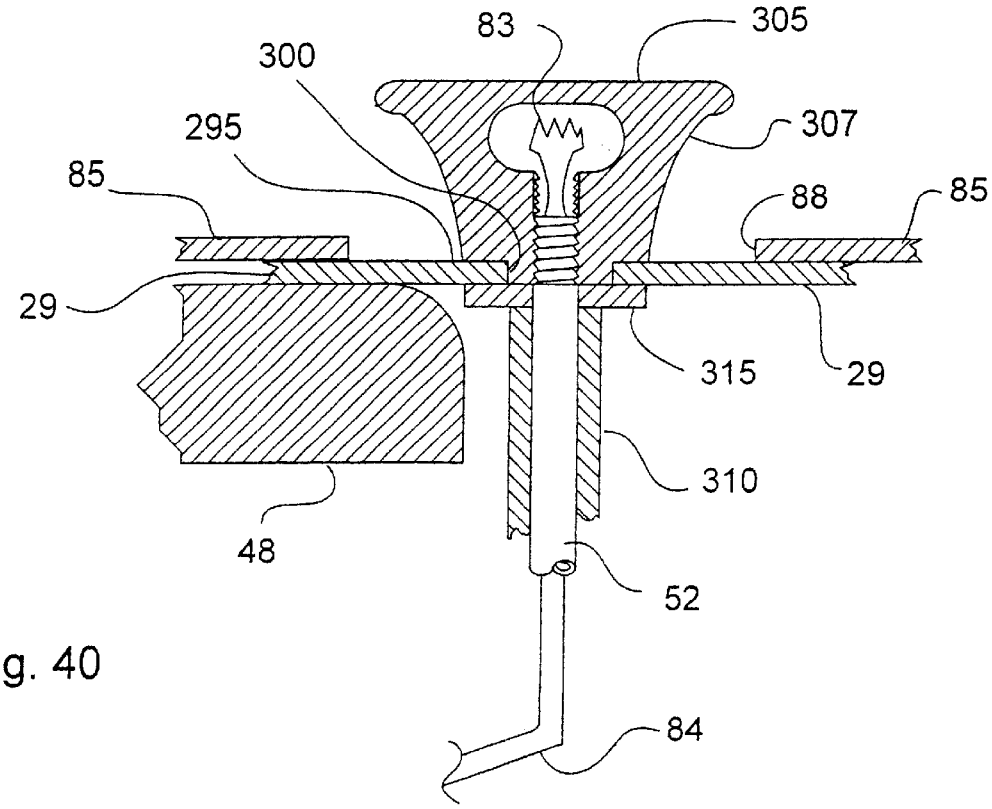
FIGS. 40–43 are sectional elevations of a tube in a die showing several stages of a prethinning process for forming a pullout in accordance with this invention.
Figure 41:
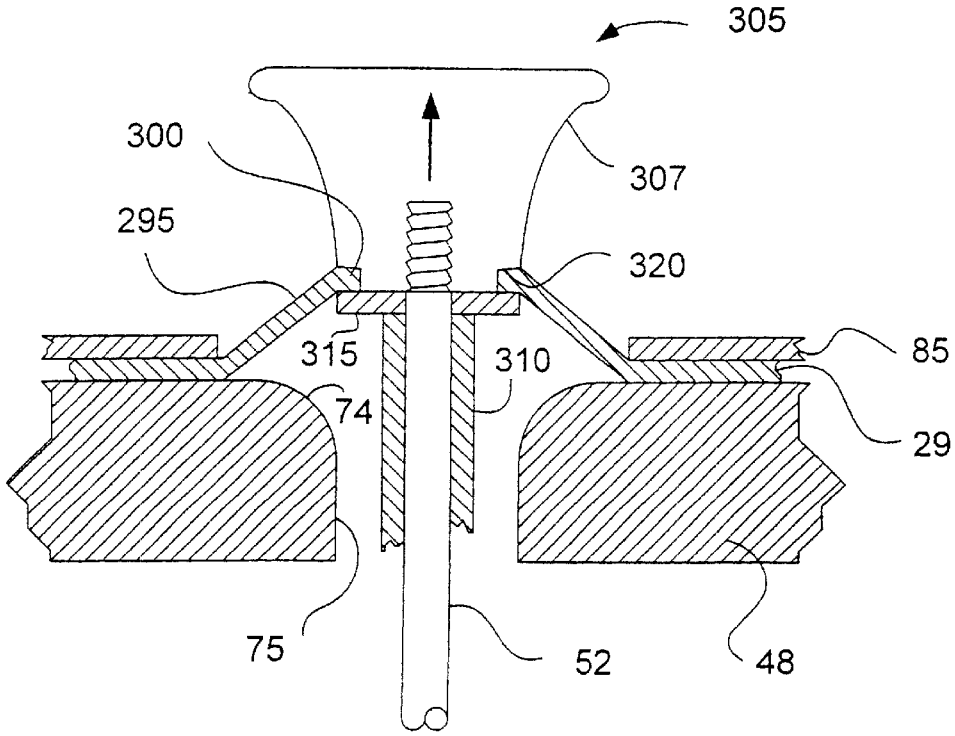
Figure 42:
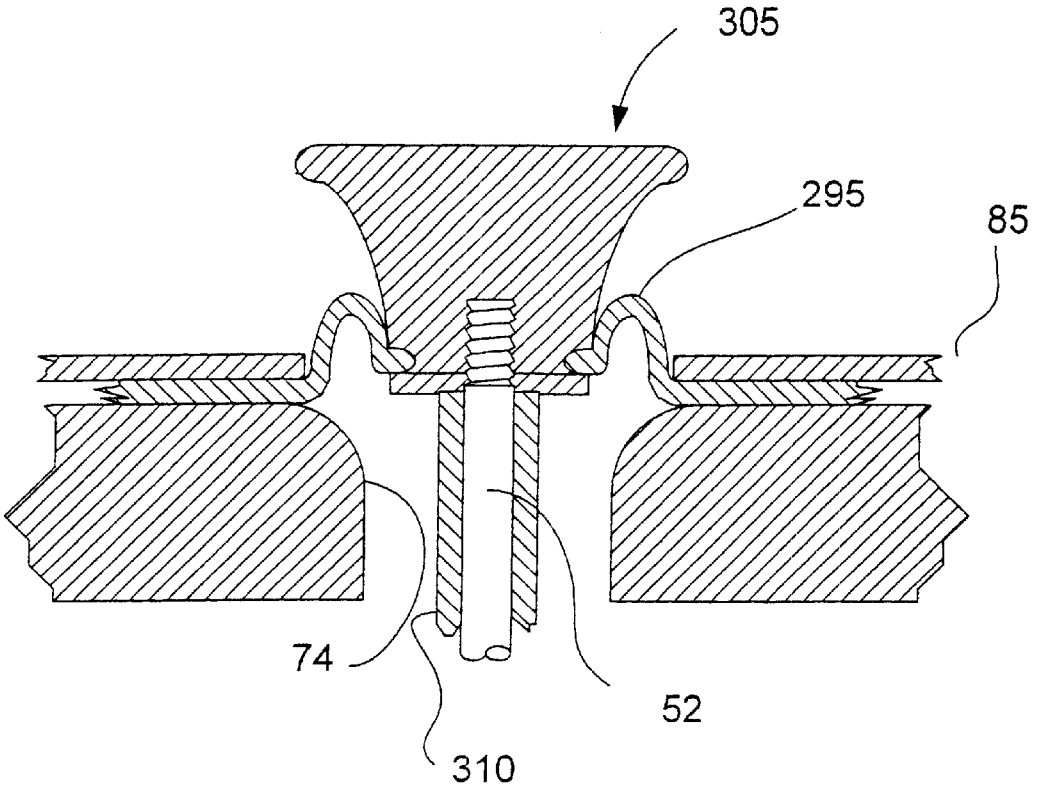

A prethinning scheme, illustrated in FIGS. 40–42, prethins the tube 29 in the intermediate regions 295 between the restraining sleeve 85 and a lip portion 300 in the region immediately surrounding the hole 80 in the tube 29. By prethinning the intermediate regions 295, the portions of the tube 29 that will be superplastically formed into the pullout 27 are preferentially prestretched so that the lip portions 300, which ordinarily are stretched the most during a forming operation of the type illustrated in FIGS. 4 and 5, are protected against excessive stretching by focusing the initial stretching initially in the intermediate portions 295. In the later phases of the cycle following the phases illustrated in FIGS. 42 and 43, the lip portion is released to stretch freely, but at that point is thicker than the intermediate portions 295, so the stretching in the later phases of the operation continue to be distributed evenly between the intermediate portions 295 and the lip portions 300 even though the lip portions have a smaller radius.

As shown in FIG. 40, an apparatus for performing a prethining operation in accordance with this invention includes a pull die 305 having a forming surface 307 by which the tube 29 is formed against the surfaces 74 and 75 of the die half 48. The pull-die 305 is shaped like the die 285 shown in FIGS. 37–39, but could be shaped like the pull-die 65 in FIG. 1 if it will not be used for diffusion bonding. A clamping tube 310 slides telescopically on the pull-rod 52 under control of the activation unit 55 to releasably clamp the lip portion 300 of the tube 29 around the hole 80 between a disc 315 and a shoulder 320 on the die 305.

In operation, a tube 29 is selected and the restraining sleeve 85 is inserted in the tube 29 with the axes of the holes 88 and 80 of the restraining sleeve 85 and the tube 29 aligned. The tube 29 and its restraining sleeve 85 are inserted into the die cavity 70 of a preheated lower die half 48 with the axis of the opening 80 aligned with the axis 77 of the bore 75. The die 305 is preheated and inserted through an open end of the tube 29 with a manipulator arm, as described previously, and the pull-rod 52 is extended and rotated to engage the threads on the distal end of the pull-rod 52 with the threaded hole in the bottom of the die 305. The pull-rod 52 is retracted slightly to engage the shoulder 320 of the pull-die 305 with the hole 80 in the tube 29 and the clamping tube 310 is slid up the pull-rod to clamp the lip portion of the tube 29 around the hole 80 between the die shoulder 320 and the disc 315.

Figure 43:
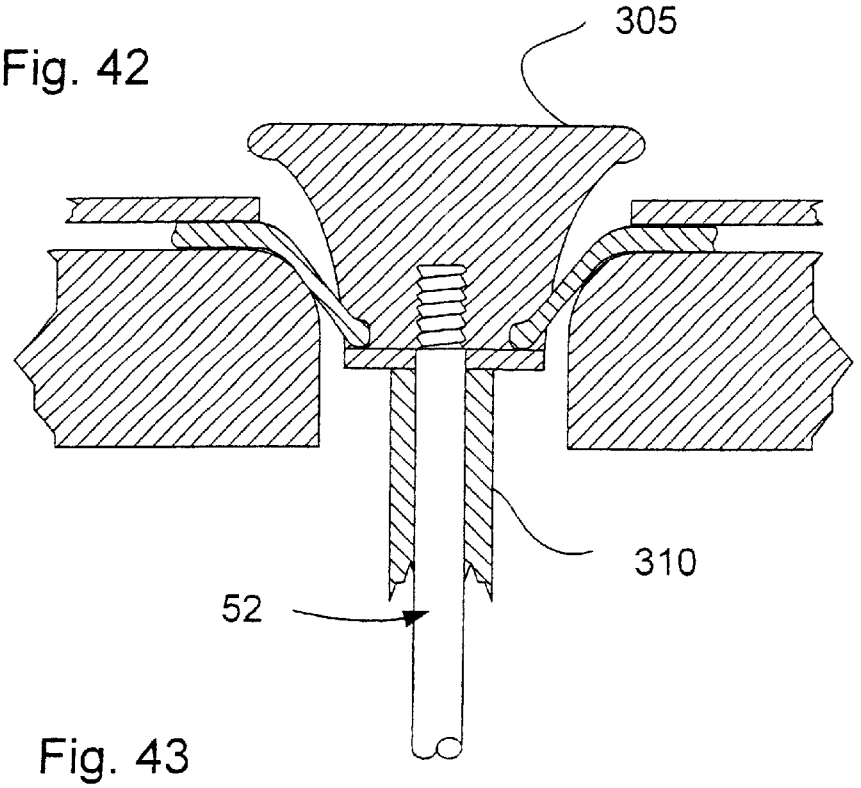

When the temperature of the tube 29 and the die 305 are at the desired superplastic forming temperature, the pull-rod 52 and clamping sleeve 310 are extended upward as shown in FIG. 41, superplastically stretching the intermediate marginal portions 295 around the hole 80 while preventing thinning of the lip portions 300 by virtue of its clamped position. The stretching rate is based on an optimal strain rate for the material of which the tube 29 is made. When the intermediate marginal portions 295 have been stretched to the desired extent, the pull-rod 52 and the clamping tube 310 are retracted downward past the initial position it had in FIG. 40. As illustrated in FIG. 42, the intermediate marginal portions 295 are now prestretched and can be laid over the tapering surfaces 74 of the die half 48 without stretching the lip portion 300 around the hole 80 in the tube 29, as shown in FIG. 43. After the position illustrated in FIG. 43 is reached, the lip portion 300 is released by withdrawing the clamping tube 310 and continuing the downward motion of the pull-die 305 to finish stretching the lip portion 300 against the sides of the opening 72 in the lower die half 48. The die 305 is now pushed back up away from the formed pullout and is detached from the pull-rod 52 by gripping the pull-die with the manipulator and rotation the pull-rod 52 to unscrew it from the pull-die 305. The die is opened and the formed part is removed as described earlier.

Obviously, numerous modifications and variations of the preferred embodiment described above will occur to those skilled in the art in light of this disclosure. Accordingly, it is my intention that these modifications and variations, and the equivalents thereof, are to be considered to be within the spirit and scope of my invention, wherein I claim:

What is claimed is:

1. An apparatus for forming a part made of a material that exhibits superplastic properties at elevated temperatures, the part having a body with an integral tubular pullout having a lead-in radiused portion ending in a tubular lip protruding from a region of the body, comprising:

a die having a die cavity including a protruding cavity portion shaped like the desired external configuration of the part in the region of said protruding pullout;

a heater for heating the body in the region of the protruding pullout to a temperature at which the material exhibits superplastic properties;

a pull die having a cross sectional shape and size about equal to the desired internal configuration of the tubular lip;

an activation unit coupled to the pull-die for moving the pull die at least partially into a hole in the material to form the pullout against internal surfaces of the protruding cavity portion; and a programmable controller for controlling operation of the activation unit to move the pull die at least partially into the protruding cavity portion on a pull rate schedule that stretches the tube material.

2. An apparatus as defined in claim 1, wherein the body is a tubular structure; and further comprising:

a retaining sleeve received concentrically within the tubular structure for holding the tubular structure against the cavity to prevent puckering of the tubular structure as the material is superplastically formed by movement of the pull die into the protruding cavity portion.

3. An apparatus for forming a part made of a material that exhibits superplastic properties at elevated temperatures, the part having a body with an integral tubular pullout having lead-in radiused portion ending in a tubular lip protruding from a region of the body, wherein the body is a tubular structure, comprising:

a die having a die cavity including a protruding cavity portion shaped like the desired external configuration of the part in the region of said protruding pullout;

a heater for heating the body in the region of the protruding pullout to a temperature at which the material exhibits superplastic properties;

a pull die having a cross sectional shape and size about equal to the desired internal configuration of the tubular lip;

an activation unit coupled to the pull-die for moving the pull die at least partially into a hole in the material to form the pullout against internal surfaces of the protruding cavity portion;

a programmable controller for controlling operation of the activation unit to move the pull die at least partially into the protruding cavity portion on a pull rate schedule that stretches the tube material;

a retaining sleeve received concentrically within the tubular structure for holding the tubular structure against the cavity to prevent puckering of the tubular structure as the material is superplastically formed by movement of the pull die into the protruding cavity portion; and a clamp member for clamping a lip portion of the material immediately around the hole while the activation unit moves the pull-die away from the protruding cavity portion of the die cavity to stretch an intermediate portion of the material outside of said lip portion while holding the lip portion against stretching, and for releasing the lip portion after laying the stretched intermediate portion on the protruding cavity portion;

wherein the pull die has surfaces that form the lip portion against the protruding cavity portion when the activation unit moves the pull die further into the protruding cavity portion after laying the stretched intermediate portion on the protruding cavity portion.

4. An apparatus for forming a part made of a material that exhibits superplastic properties at elevated temperatures, the part having a body wherein the body is a tubular structure with an integral tubular pullout having a lead-in radiused portion ending in a tubular lip protruding from a region of the body, comprising:

a die having a die cavity including a protruding cavity portion shaped like the desired external configuration of the part in the region of the protruding pullout;

a heater for heating the body in the region of the protruding pullout to a temperature at which the material exhibits superplastic properties;

a pull die having a cross-sectional shape and size about equal to the desired internal configuration of the tubular lip;

an activation unit coupled to the pull-die for moving the pull die at least partially into a hole in the material to form the pullout against internal surfaces of the protruding cavity portion;

a programmable controller for controlling operation of the activation unit to move the pull die at least partially into the protruding cavity portion on a pull rate schedule that stretches the tube material;

a retaining sleeve received concentrically within the tubular structure for holding the tubular structure against the cavity to prevent puckering of the tubular structure as the material is superplastically formed by movement of the pull die into the protruding cavity portion;

a clamp member for clamping a lip portion of the material immediately around the hole while the activation unit moves the pull-die away from the protruding cavity portion of the die cavity to stretch an intermediate portion of the material outside of the lip portion while holding the lip portion against stretching, and for releasing the lip portion after laying the stretched intermediate portion on the protruding cavity portion; and the pull die having surfaces that form the lip portion against the protruding cavity portion when the activation unit moves the pull die further into the protruding cavity portion after laying the stretched intermediate portion on the protruding cavity portion, wherein:

the clamp member includes a clamping tube telescopically disposed on a pull-rod connecting the activation unit and the pull-die; and an actuator for moving said clamping tube on the pull-rod independently of the pull-rod.

5. An apparatus as defined in claim 4, wherein:

the pull die has an external shape like the internal shape of the lead-in radiused portion of the pullout; and the protruding cavity potion of the die cavity is sized to receive a stub tube onto which the pullout can be formed and pressed against for diffusion bonding of the pullout to the stub tube.

* * * * *